US006309788B1

(12) United States Patent
Tsuji et al.

(10) Patent No.: US 6,309,788 B1
(45) Date of Patent: Oct. 30, 2001

(54) PROCESS FOR PRODUCING TONER

(75) Inventors: Yoshinori Tsuji, Shizuoka-ken; Atsushi Kubo, Moriya-machi; Minoru Ohmura, Toride; Hitoshi Kanda, Yokohama; Takeshi Tsujino, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/433,559

(22) Filed: Nov. 4, 1999

(30) Foreign Application Priority Data

Nov. 6, 1998 (JP) ..... 10-316051
Jul. 5, 1999 (JP) ..... 11-190063
Sep. 28, 1999 (JP) ..... 11-273548

(51) Int. Cl.[7] ..... G03G 9/08

(52) U.S. Cl. ..... 430/137.17; 430/110.4; 523/223; 523/303; 523/319; 523/348

(58) Field of Search ..... 430/137, 106, 430/111; 524/460, 700; 523/223, 303, 319, 348

(56) References Cited

U.S. PATENT DOCUMENTS 2,297,691 10/1942 Carlson .
5,087,546 2/1992 Kanda et al. ..... 430/137
5,865,381 2/1999 Mitsumura et al. ..... 241/18
5,973,054 * 10/1999 Kushino et al. ..... 430/137

FOREIGN PATENT DOCUMENTS 0524016 1/1993 (EP) .
0686885 12/1995 (EP) .
0730205 9/1996 (EP) .
36-10231 7/1961 (JP) .
43-10799 5/1968 (JP) .
51-14895 5/1976 (JP) .
59-053856 3/1984 (JP) .
59-061842 4/1984 (JP) .
06-11900 1/1994 (JP) .
06-075429 3/1994 (JP) .

OTHER PUBLICATIONS

W.A. Lee et al., The Glass Transition Temperatures of Polymers, Polymer Handbook, 2d Ed., Publ. by Wiley–Interscience, pp. 111–139 to 111–192 (Jan. 1, 1975).

* cited by examiner

*Primary Examiner*—Janis L. Dote
(74) *Attorney, Agent, or Firm*—Fitzpatrick, Cella, Harper & Scinto

(57) ABSTRACT

A process for producing a toner. The process has the steps of dispersing a fine-particle colorant in a liquid monomer mixture containing at least a liquid polymerizable monomer, dispersing the resulting colorant-dispersed liquid monomer mixture in an aqueous dispersion medium to form particles of a polymerizable monomer composition, and polymerizing polymerizable monomers present in the particles in the aqueous dispersion medium to form toner particles. In the dispersion step, a media particle agitation type wet-dispersion machine is used as a dispersion means. The dispersion machine has a cylindrical vessel having a first wall surface having a liquid-feed opening and a second wall surface having a liquid-discharge opening. The vessel is inside provided with an inner chamber and an outer chamber which are partitioned with a cylindrical separator having slits, a rotor set in the inner chamber rotatably by the rotary drive motion of a drive shaft, and a plurality of spherical media particles held in the inner chamber.

80 Claims, 10 Drawing Sheets

TONER PARTICLE CROSS SECTIONS

PRIOR ART

PRIOR ART

PROCESS FOR PRODUCING TONER

BACKGROUND OF THE INVENTION

1. Field of the Invention

This invention relates to a process for producing a toner having a good electrophotographic performance, having toner particles in which a fine-particle colorant stands finely and uniformly dispersed. More particularly, this invention relates to a process for producing a toner by polymerizing polymerizable monomers in an aqueous medium to form toner particles; the monomers being present in particles of a polymerizable monomer composition in which a fine-particle colorant stands finely and uniformly dispersed.

2. Related Background Art

A number of methods as disclosed in U.S. Pat. No. 2,297,691, etc. are known as electrophotography. In general, using a photoconductive material, copies or prints are obtained by forming an electrostatic latent image on a photosensitive member, subsequently developing the electrostatic latent image by the use of a toner to form a toner image, transferring the toner image to a transfer medium such as paper as occasion calls, and thereafter fixing the toner image onto the transfer medium by the action of heat, pressure, heat-and-pressure or solvent vapor. As methods for developing the electrostatic image by the use of toners or methods for fixing the toner image, a variety of methods have been proposed, and methods suited for individual image-forming processes are employed.

Toners used for such purpose have been commonly produced by melt-kneading colorants comprising dyes or pigments, into thermoplastic resins to effect uniform dispersion, followed by pulverization using a fine grinding mill and classification using a classifier to produce toners having the desired particle diameters.

Reasonably good toners can be produced by such a production method, but there is a limit to the range in which toner materials are selected. For example, colorant-dispersed resins must be brittle enough to be pulverizable with ease by means of a fine grinding mill economically available. Such colorant-dispersed resin having been made brittle tend to result in a broad particle size distribution of the particles formed when actually pulverized at a high speed, especially causing a problem that relatively large particles tend to be produced. Moreover, such highly brittle materials tend to be further pulverized in developing assemblies of copying machines or the like. Also, it is difficult to uniformly disperse solid fine particles of colorants or the like in the resin, and some toners cause an increase in fog, a decrease in image density and a lowering of color mixing properties or transparency, depending on the degree of dispersion. Also, colorants may come bare to rupture sections of pulverized particles, and may cause fluctuations in developing performance of toners.

Meanwhile, in order to overcome the problems of the toners produced by such pulverization, toners produced by suspension polymerization, toners produced by various polymerization and their production processes are disclosed in Japanese Patent Publications No. 36-10231, No. 43-10799, No. 51-14895 and so forth. For example, in the process for producing toners by suspension polymerization, a polymerizable monomer, a colorant and a polymerization initiator, and also optionally a cross-linking agent, a charge control agent and other additives are uniformly dissolved or dispersed to form a polymerizable monomer composition. Thereafter, this polymerizable monomer composition is dispersed in a continuous phase (e.g., an aqueous medium) containing a dispersion stabilizer, by means of a suitable agitator, and is simultaneously subjected to polymerization reaction to obtain toner particles having the desired particle diameters.

Since this method has no step of pulverization, the toner particles are not required to be brittle, and hence soft materials can be used as the resin. Also, colorants do not come bare to the surfaces of toner particles, and hence the toner particles having a uniform triboelectric charging performance can be obtained. This method has such advantages. Also, since the toner particles obtained have a relatively sharp particle size distribution, the step of classification can be omitted, or, even when classified, toner particles can be obtained in a high yield. The method also has the advantage that, since a low-softening substance can be encapsulated in toner particles in a large quantity, the toner particles obtained have a superior anti-offset properties.

When the monomer mixtures containing a fine-particle colorant are obtained, it has been common to use a DYNO-MILL brand dispersion mill, having been made commercially available from Shinmaru Enterprises Corporation as disclosed in Japanese Patent Application Laid-Open No. 6-11900; or a COBAL-MILL brand dispersion mill, manufactured by Shinko Pantec Co., Ltd. as disclosed in Japanese Patent Application Laid-Open No. 6-75429.

A cross-section of the main body of the DYNO-MILL brand dispersion mill and a diagram of a system incorporated with the main body are shown in FIG. 10. Reference numeral 121 denotes a main-body casing; 122, a material feed opening; 123, a discharge opening; 124, an agitator shaft; 125, media; 126, a circulating pump; 127, a holding tank; 128, agitator disks; and 129, a motor. A dispersion target liquid material put into the holding tank 127 is fed through the material feed opening 122 by means of the circulating pump 126, passed through the layers of media 125 repeating their motion by a rotational force of the agitator disks 128 to effect dispersion, then separated from the media, thereafter discharged through the discharge opening 123, and returned to the holding tank 127. This cycle is repeated to carry out dispersion.

A cross-section of the main body of the COBALL-MILL brand dispersion mill and a diagram of a system incorporated with the main body are shown in FIG. 11. Reference numeral 231 denotes a main-body casing; 232, a material feed opening; 233, a discharge opening; 234, a media separator; 235, media layers; 236, a circulating pump; 237, a holding tank; and 238, a rotor. A dispersion target liquid material put into the holding tank 237 is fed through the material feed opening 232 by means of the circulating pump 236, passed through the media layers 235 repeating their motion by a rotational force of the rotor 238 to effect dispersion, then separated from the media by the media separator 234, thereafter discharged through the discharge opening 238, and returned to the holding tank 237. This cycle is repeated to carry out dispersion.

However, the use of such a conventional media type dispersion machine to obtain the fine-particle-colorant-containing monomer mixture may remarkably cause "packing", which is a phenomenon where the media is pushed outward against the wall when the centrifugal force of the rotor is stronger than the flow of the monomer mixture, because the direction in which the monomer mixture flows is not in agreement with the direction of centrifugal force. This makes non-uniform the media-packed layers in the machine. As the result, the flow of the monomer mixture tends to pass through the part where the media layers have become thin to have a small flow resistance, bringing about a problem that the dispersion efficiency lowers greatly.

When on the other hand the centrifugal force of the rotor is weaker than the flow of the monomer mixture, the media is inevitably carried away toward the discharge opening because of the flow of the monomer mixture to cause a phenomenon of "blocking" of media in the vicinity of the discharge opening, making it difficult to operate the machine stably. Thus, it has been difficult to keep a balance between the centrifugal force caused by the rotation of the rotor and the flow of the monomer mixture so as to stably produce the fine-particle-colorant-containing monomer mixture.

In addition, a decrease of image density may occur when images are formed using a toner having toner particles obtained using a fine-particle-colorant-containing monomer mixture in which a colorant and a charge control agent stand dispersed insufficiently. There is a problem that granulation performance tend to lower when such an insufficiently dispersed fine-particle-colorant-containing monomer mixture is used to carry out granulation in an aqueous medium containing a dispersion stabilizer. Accordingly, in order to obtain a well dispersed fine-particle-colorant-containing monomer mixture by means of the media type dispersion machine, it is necessary to improve media efficiency. In order to improve the media efficiency, media having a small diameter, stated specifically, media of 2 mm or smaller in diameter may be used, whereby the media efficiency is greatly improved. However, the use of the media of 2 mm or smaller in diameter results in a high packing to more tend to cause the above phenomena of packing and blocking, thus it has been difficult to operate the machine stably and also difficult to produce the fine-particle-colorant-containing monomer mixture stably.

In order to obtain a well dispersed fine-particle-colorant-containing monomer mixture by means of the conventional media type dispersion machine while relieving the phenomena of packing and blocking, it is preferable to use beads larger than 2 mm, and more preferably beads of 3 mm or larger. This, however, has taken a long timer to achieve the intended dispersion.

SUMMARY OF THE INVENTION

An object of the present invention is to provide a toner production process having solved the problems discussed above.

Another object of the present invention is to provide, in a process for producing toner by polymerization, a production process by which a toner having a colorant dispersed more uniformly and promising a good image density can be produced in a good efficiency and stably.

Still another object of the present invention is to provide, in a process for producing toner by polymerization, a production process by which a toner being uniform in quality and having a sharp particle size distribution can be produced in a good efficiency and stably.

To achieve the above objects, the present invention provides a process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a granulation step of dispersing the resulting fine-particle-colorant-dispersed liquid monomer mixture in an aqueous dispersion medium to form particles of a polymerizable monomer composition; and a polymerization step of polymerizing polymerizable monomers present in the particles of the polymerizable monomer composition, in the aqueous dispersion medium to form toner particles;

wherein;

(A) in the dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber; and (B) (i) the fine-particle colorant is introduced to the center of the inner chamber through the liquid-feed opening together with the liquid monomer mixture while rotating the rotor by rotary-driving the drive shaft;

(ii) the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles; and (iii) the liquid monomer mixture in which the fine-particle colorant has been dispersed is discharged out of the outer chamber through the liquid-discharge opening to obtain a fine-particle-colorant-containing monomer mixture.

The present invention also provides a process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a preparation step of adding a polymerization initiator to the fine-particle-colorant-dispersed liquid monomer mixture in which the fine-particle colorant has been dispersed, to prepare a polymerizable monomer composition;

a granulation step of dispersing the polymerizable monomer composition in an aqueous dispersion medium to form particles of the polymerizable monomer composition; and a polymerization step of polymerizing polymerizable monomers present in the particles of the polymerizable monomer composition, in the aqueous dispersion medium to form toner particles;

wherein;

in the dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber;

the fine-particle colorant is introduced to the center of the inner chamber through the liquid-feed opening together with the liquid monomer mixture while rotating the rotor by rotary-driving the drive shaft;

the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles;

the liquid monomer mixture in which the fine-particle colorant has been dispersed is discharged out of the outer chamber through the liquid-discharge opening;

the liquid monomer mixture in which the fine-particle colorant has been dispersed, thus discharged, is controlled to have a liquid temperature of from 10° C. to 40° C.;

the liquid monomer mixture in which the fine-particle colorant has been dispersed, thus controlled to have a liquid temperature of from 10° C. to 40° C., is again introduced to the center of the inner chamber through the liquid-feed opening to disperse the fine-particle colorant in the liquid monomer mixture;

the dispersion is carried out for a prescribed time to disperse the fine-particle colorant in the liquid monomer mixture to obtain a fine-particle-colorant-containing monomer mixture; and the fine-particle-colorant-containing monomer mixture obtained is fed to the preparation step.

The present invention still also provides a process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a preparation step of adding a polymerization initiator to the fine-particle-colorant-dispersed liquid monomer mixture in which the fine-particle colorant has been dispersed, to prepare a polymerizable monomer composition;

a granulation step of dispersing the polymerizable monomer composition in an aqueous dispersion medium to form particles of the polymerizable monomer composition; and a polymerization step of polymerizing polymerizable monomers present in the particles of the polymerizable monomer composition, in the aqueous dispersion medium to form toner particles;

wherein;

(A) in the dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber;

(B) (i) the fine-particle colorant is introduced to the center of the inner chamber through the liquid-feed opening together with the liquid monomer mixture while rotating the rotor by rotary-driving the drive shaft;

(ii) the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles;

(iii) the liquid monomer mixture in which the fine-particle colorant has been dispersed is discharged out of the outer chamber through the liquid-discharge opening, and the liquid monomer mixture in which the fine-particle colorant has been dispersed, thus discharged, is controlled to have a liquid temperature of from 10° C. to 40° C.; and (iv) the liquid monomer mixture in which the fine-particle colorant has been dispersed, thus controlled to have a liquid temperature of from 10° C. to 40° C., is again introduced to the center of the inner chamber through the liquid-feed opening to disperse the fine-particle colorant in the liquid monomer mixture, where;

the viscosity of the liquid monomer mixture is measured with a viscometer provided between the liquid-discharge opening and the liquid-feed opening, and the dispersion is carried out for a prescribed time while controlling the number of revolutions of the rotor in accordance with the measured viscosity, to disperse the fine-particle colorant in the liquid monomer mixture to obtain a fine-particle-colorant-containing monomer mixture; and (C) the fine-particle-colorant-containing monomer mixture obtained is fed to the preparation step.

DETAILED DESCRIPTION OF THE PREFERRED EMBODIMENTS

As a result of extensive studies, the present inventors have discovered that colorants can be dispersed in polymerizable monomers in a short time and stably when dispersed by means of a media type dispersion machine in which the direction of the flow of a monomer mixture is in agreement with the direction of the centrifugal force produced by the rotation of a rotor, thus they have accomplished the present invention.

Figure 1:
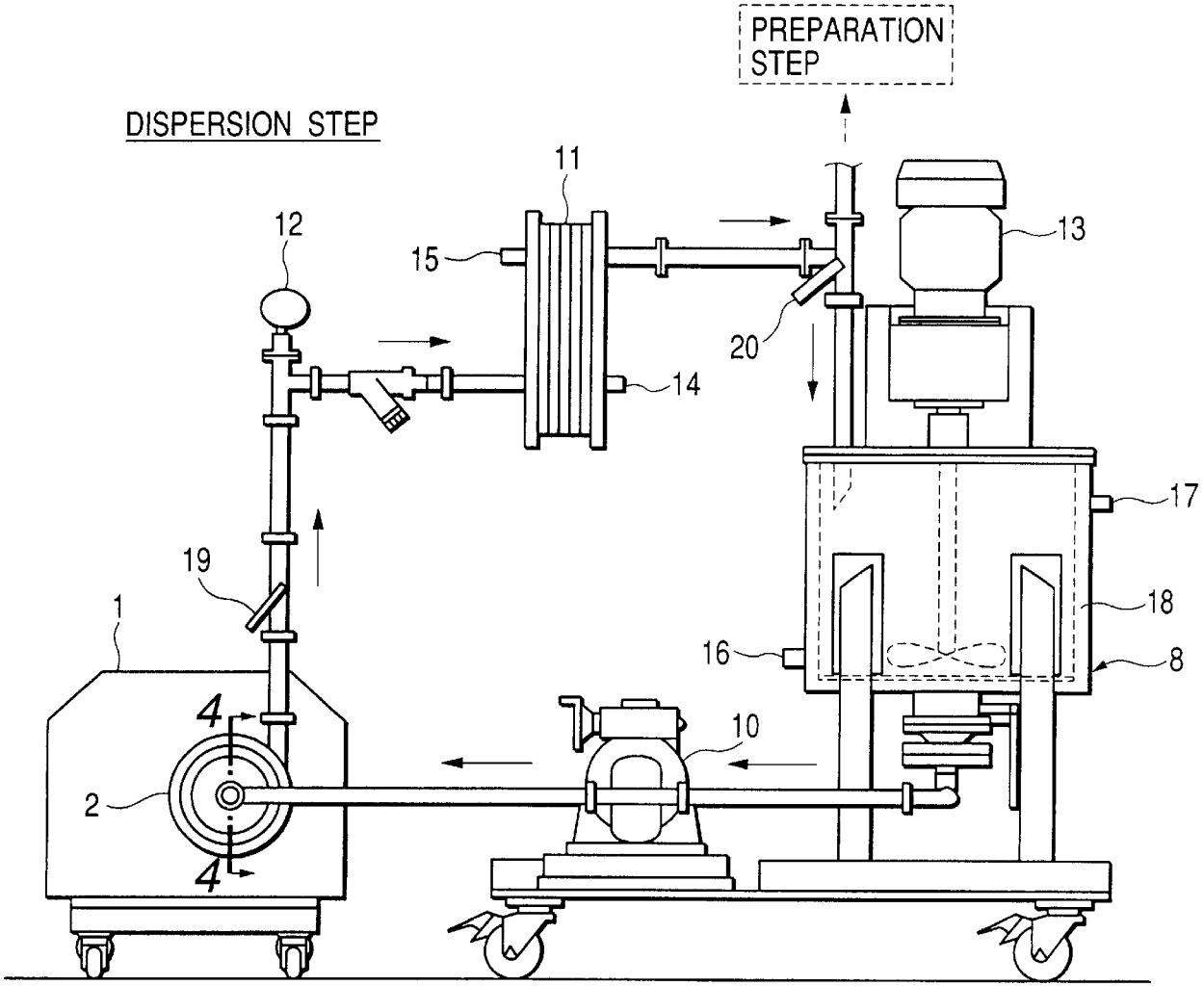
FIG. 1 illustrates a dispersion step making use of a media particle agitation type wet-dispersion machine, a cooling means, a holding tank and a circulating pump.
Figure 2:
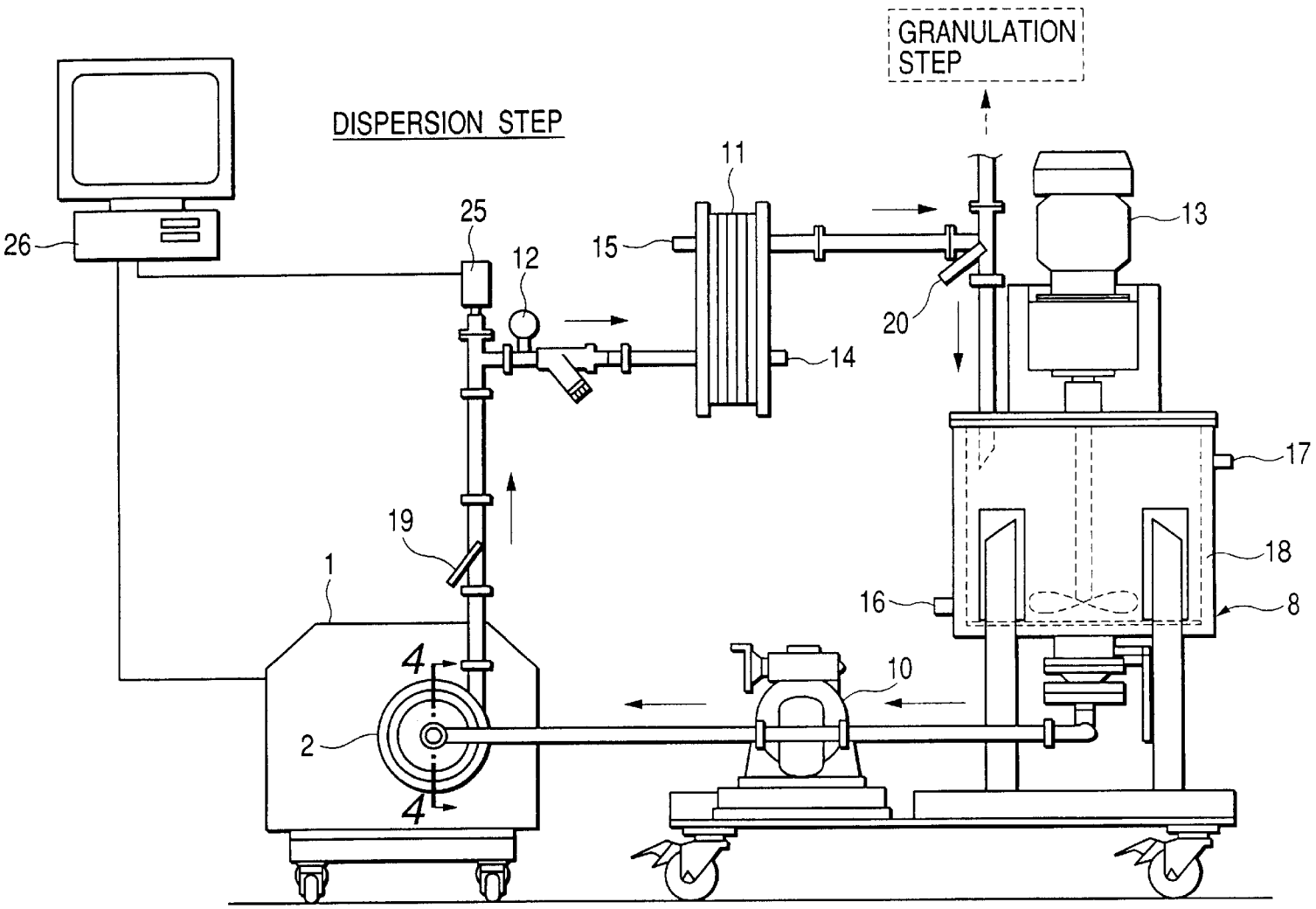
FIG. 2 illustrates a dispersion step making use of a media particle agitation type wet-dispersion machine, a viscometer, a dispersion machine rotor revolution controlling personal computer (a personal computer for controlling the number of revolutions of a dispersion machine rotor), a cooling means, a holding tank and a circulating pump.
Figure 3:
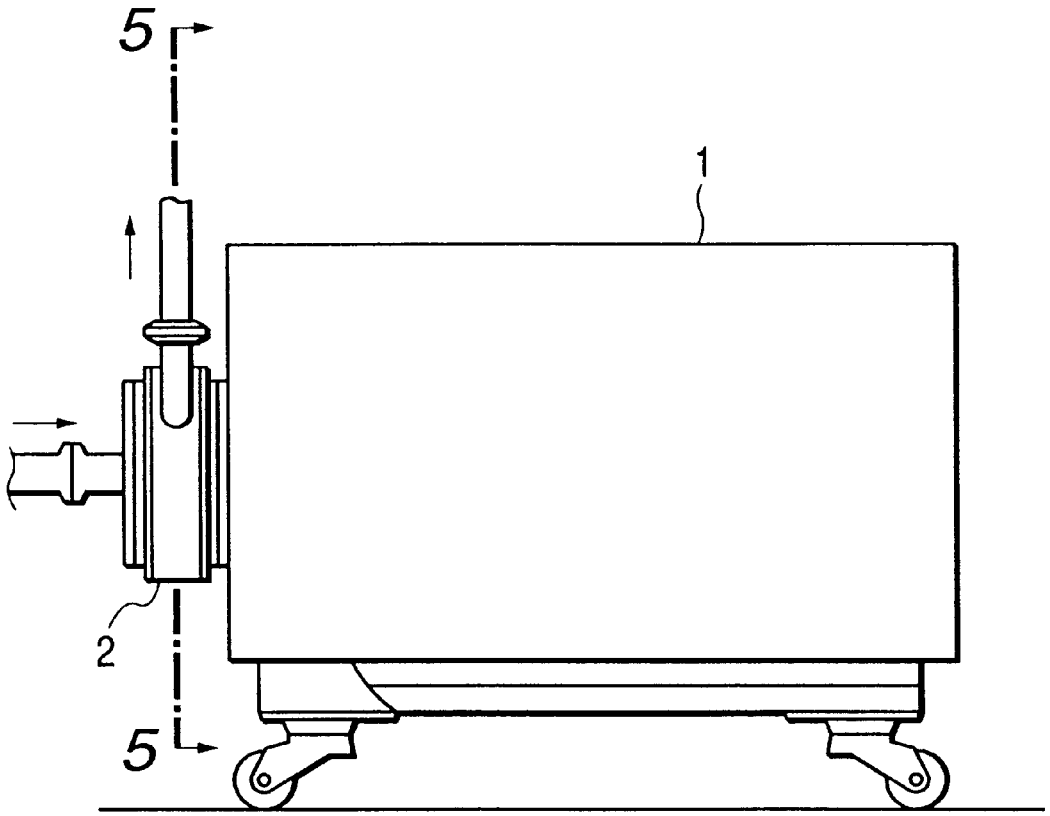
FIG. 3 is a side view of the dispersion machine.
Figure 4:
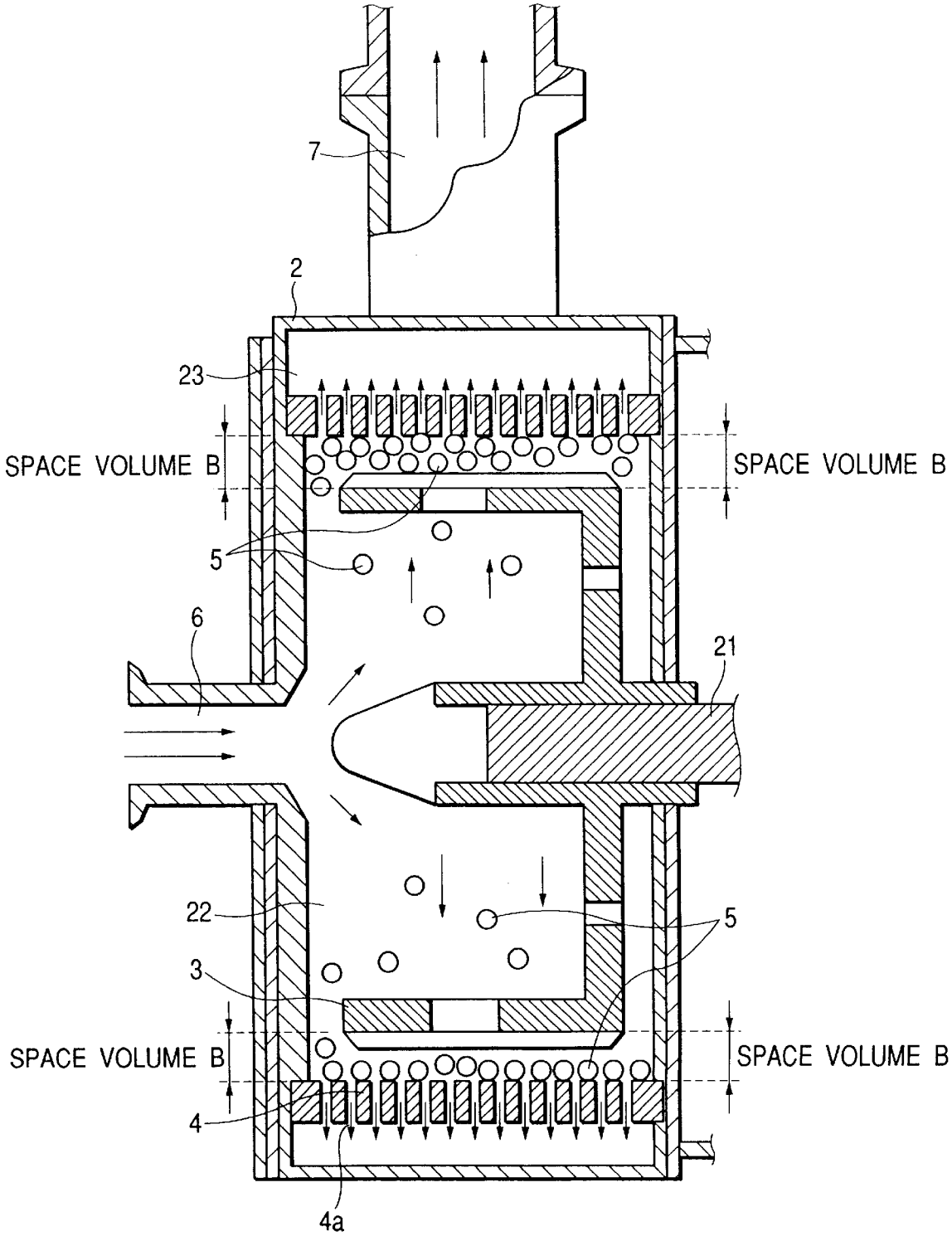
FIG. 4 is a cross-sectional view of the inside of a casing along the line 4—4 in FIGS. 1 and 2.
Figure 5:
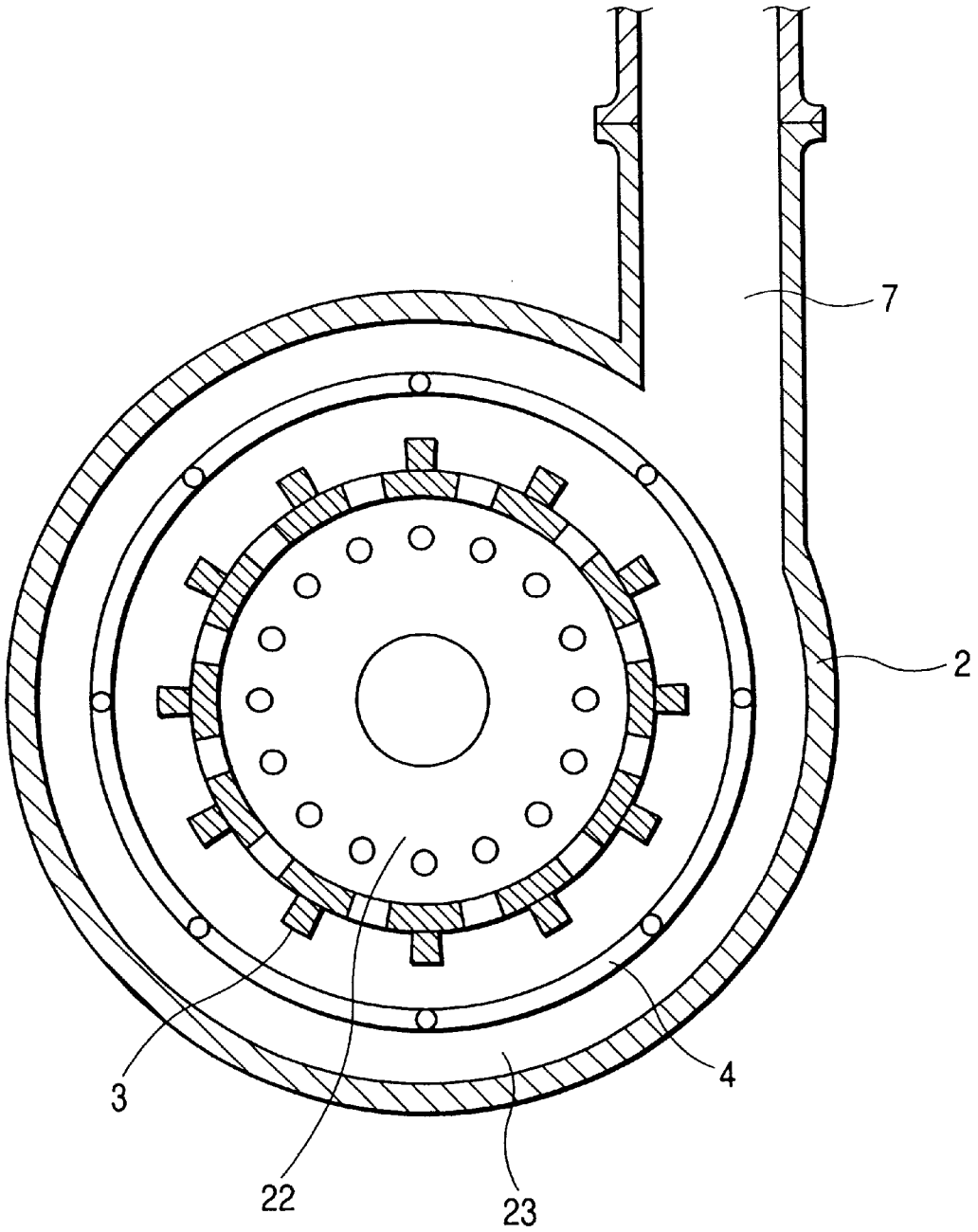
FIG. 5 is a cross-sectional view of the inside of a casing along the line 5—5 in FIG. 3.

As examples of the media type dispersion machine used in the present invention, dispersion machines shown in FIGS. 1 to 5 are preferably used. FIG. 1 shows an example of a dispersion system incorporated with a media particle agitation type wet-dispersion machine, used in the present invention. FIG. 2 shows an example of a dispersion system incorporated with a media particle agitation type wet-dispersion machine and a viscosity measuring system, used in the present invention. FIG. 3 is a side view of the dispersion machine main body used in the present invention. FIG. 4 is a cross-sectional view along the line 4—4 in FIGS. 1 and 2, and FIG. 5 a cross-sectional view along the line 5—5 in FIG. 3. A dispersion machine 1 shown in FIGS. 1 to 5 comprises a casing 2 and provided on its inside with a rotor 3 for agitating media particles 5 and, along the periphery of the rotor, a separator 4 having slits 4*a* for separating the media particles 5 from a liquid monomer mixture. Centrifugal force is produced by rotating the rotor 3, and this centrifugal force causes the media particles 5 to form a layer on the separator 4 provided along the rotor's periphery. At the same time, the rotational force of the rotor 3 causes a rotary motion. Hence, a strong shear force is produced to disperse the fine-particle colorant in polymerizable monomers.

The liquid monomer mixture put into a holding tank 8 is fed into the dispersion machine 1 through a material feed opening 6 by means of a circulating pump 10, and, by the aid of the centrifugal force produced by the rotation of the rotor 3, it is passed through the media layer formed along the periphery of the rotor to become surely finely dispersed. Thereafter, the liquid monomer mixture is separated from the media particles 5 by the separator 4, then discharged out of the dispersion machine through a discharge opening 7, and returned to the holding tank 8 through a pipe provided with a viscometer 25 and/or a thermometer 12 and through a cooling means 11. The monomer mixture held in the holding tank 8 is repeatedly circulated between the dispersion machine 1 and the holding tank 8, during which the fine-particle colorant is dispersed in the polymerizable monomer uniformly and in a good efficiency.

The circulation that the liquid monomer mixture returned to the holding tank 8 is again introduced into the dispersion machine through the material feed opening 6 is repeated.

Figure 6:
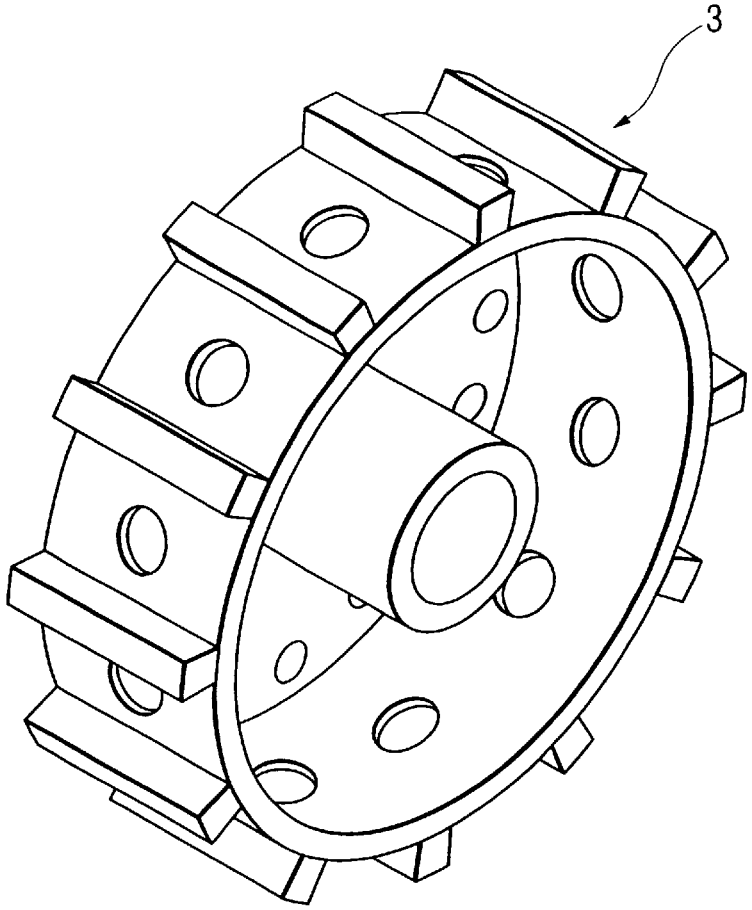
FIG. 6 is a perspective view of a rotor.
Figure 7:
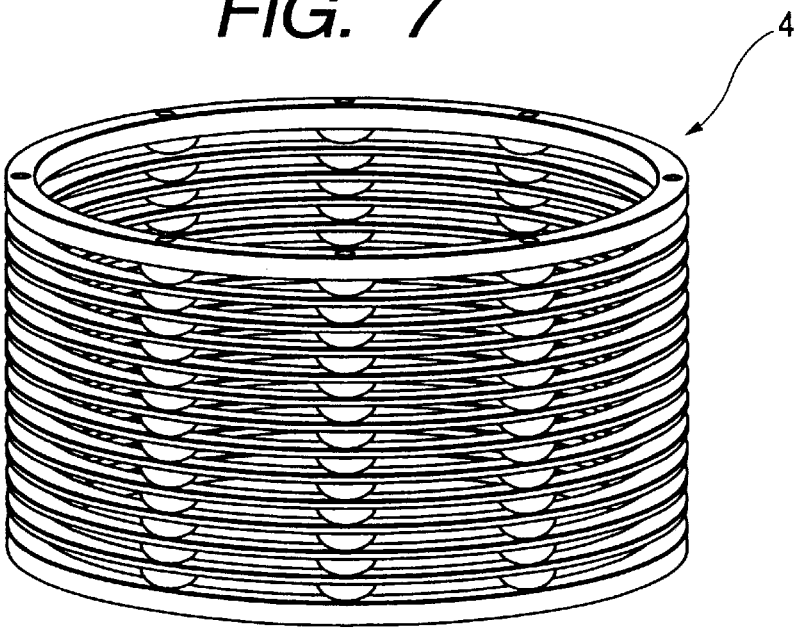
FIG. 7 is a perspective view of a separator.

The rotor 3 is perspectively illustrated in FIG. 6. The separator 4 is perspectively illustrated in FIG. 7.

The polymerizable monomer, colorant, charge control agent and so forth may be put into the holding tank 8 directly, or may provisionally be mixed and thereafter put into the holding tank 8.

Heat tends to be generated during the dispersion to adversely affect the monomer mixture. Accordingly, a heat exchanger may be provided as a cooling means in the line of the circulation system so that the dispersion system can be operated while making heat exchange. In such an instance, the monomer mixture may preferably be controlled to have a liquid temperature of from 10 to 40° C., and more preferably from 15 to 35° C. The fine-particle-colorant-containing monomer mixture discharged through the liquid-discharge opening may preferably have a viscosity of from 5 to 2,500 mPa·s, more preferably from 20 to 2,000 mPa·s, and still more preferably from 50 to 2,000 mPa·s.

In the dispersion machine as shown in FIGS. 1 to 5, the media particles used may preferably have a diameter within the range of from 0.1 mm to 2 mm in view of the dispersibility of colorants in polymerizable monomers.

In view of the dispersibility of colorants, the wear of media particles and the stable operation of the system itself, the relationship between a total volume A of media particles present in the dispersion machine and a space volume B between the rotor 3 and the separator 4 may preferably be in the range of:

$$0.7<A/B<1.3.$$

The total volume A of media particles is a value represented by:

$$A=D/C$$

where C is a bulk density of the media particles, and D is a charge weight of media particles put into the machine. Media particles whose charge weight D has been accurately weighed are put into a measuring cylinder to measure the total volume A of media particles accurately.

The space volume B between the rotor 3 and the separator 4 corresponds to the total volume of the part shown in FIG. 4.

In view of the dispersibility of colorants, the wear of media particles and the stable operation of the system itself, the rotor may preferably be rotated at a peripheral speed at the tip portion ranging from 5 to 20 m/s, and more preferably from 7 to 17 m/s.

In order to prevent the media particles from wearing and to achieve stable continuous operation of the system itself and reduction of power consumption, the viscometer 25 may be provided between the liquid-discharge opening 7 and the liquid-feed opening 6 to measure the viscosity of the fine-particle-colorant-containing monomer mixture, which changes in accordance with the degree of dispersion of the colorant and others. In accordance with the values of viscosity thus measured, the peripheral speed of the rotor at the tip portion may preferably be controlled in the above range of from 5 to 20 m/s, and more preferably from 7 to 17 m/s. Stated specifically, it is preferable for the rotor to be rotated at a low speed (small number of revolutions) when the fine-particle-colorant-containing monomer mixture has a low viscosity, and rotated at a high speed (large number of revolutions) when the mixture has reached a certain viscosity or above. If the rotor is driven at a higher peripheral speed (stated specifically, 7 m/s or above at the tip portion) at the initial stage of treatment where the colorant has not been dispersed to a high degree, the liquid monomer mixture has so small a viscosity that it is difficult for the liquid monomer mixture to become present between individual media particles, so that the friction between the media particles tends to become predominant in the dispersion machine. As the result, the wear of media particles may increase, and any additional power against the friction may be required to tend to consume a large volume of power. Because of an increase in the friction, the media particles may greatly wear to shorten a period for changing media particles for new ones. This is not desirable for the operation of system in a good cost efficiency. The colorant is dispersed to a higher degree and the liquid monomer mixture reaches a prescribed viscosity (e.g., 50 mPa·s or above), where the peripheral speed at the tip portion of the rotor may be made 7 m/s or higher. By doing so, the degree of dispersion can be made higher very well and the treatment time can be shortened.

Such a viscometer may specifically include a vibration viscometer FUM-80A Shield Type (manufactured by Yamaichi Denki K.K.) and MIV16001 ADF Type (manufactured by Sofraser Co., Ltd.).

In a personal computer 26 in the system shown in FIG. 2, a predetermined viscosity is previously set, and also two points are set for low-speed rotation and high-speed rotation as the number of revolutions of the rotor. With the starting of operation, the rotor begins to be driven at a low-speed rotation and the viscometer set in the system begins to measure the viscosity of the monomer mixture. The values of the viscosity of the fine-particle-colorant-containing monomer mixture, measured with the viscometer 25, are inputted to the personal computer 26. When the viscosity reaches to a preset value, signals for changing the rotor to the mode of high-speed rotation are outputted to make the rotor rotate at a high speed.

The dispersion is carried out while applying a pressure to the inside of the dispersion machine, and hence a valve 19 is provided on the downstream side of the discharge opening 7. This is preferable because the dispersion efficiency of colorants can be improved and also short pass can be prevented. The dispersion may preferably be carried out for 10 to 300 minutes, and more preferably 20 to 180 minutes, as treating time.

Materials for the media particles used in the dispersion machine may include glass, steel, chromium alloys, alumina, zirconia, zircon and titania. Of these media materials, zirconia and titania are preferred in view of wear resistance.

Such a media type dispersion machine may specifically include SC mill (manufactured by Mitsui Mining & Smelting Co., Ltd.).

In the present invention, the process for producing toner particles by polymerization may include processes for producing toner particles directly by suspension polymerization as disclosed in Japanese Patent Publication No. 36-10231 and Japanese Patent Applications Laid-open No. 59-53856 and No. 59-61842.

Figure 8:
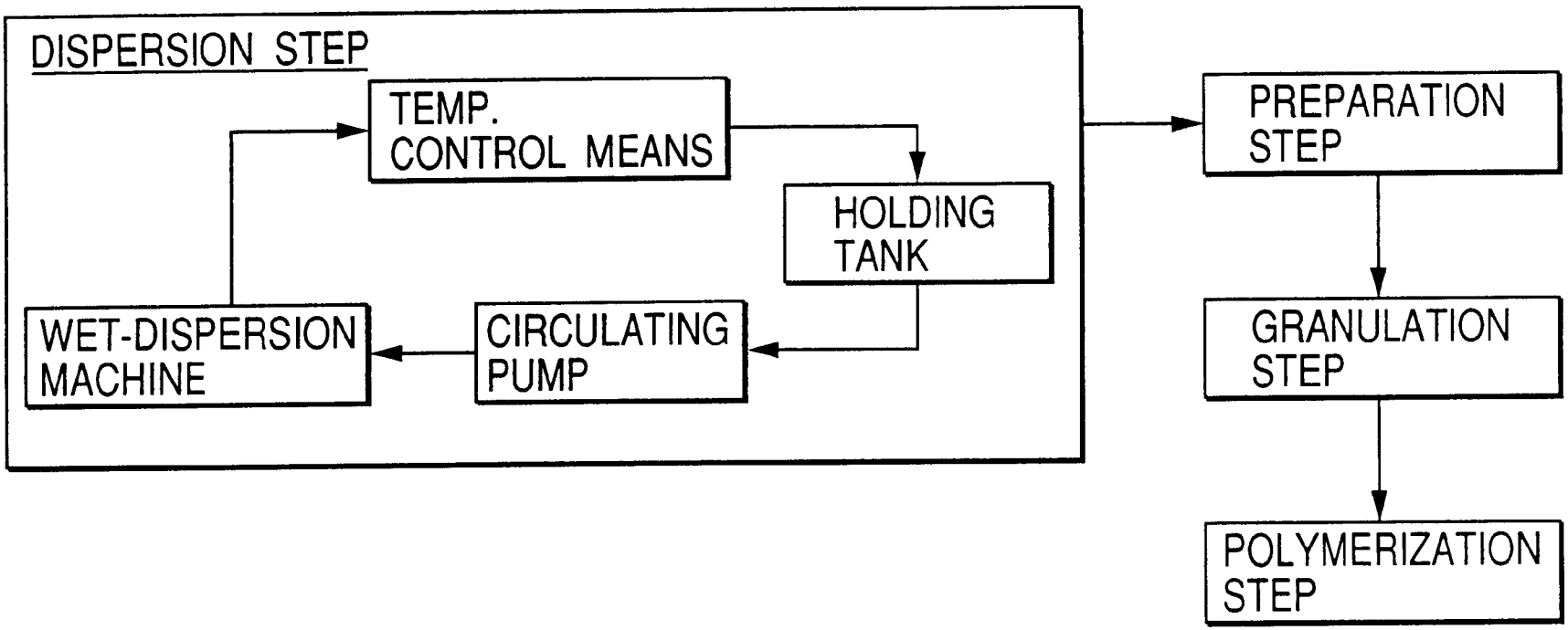
FIG. 8 shows an example of a flow chart relating to a process for producing toner particles according to the present invention.

In the present invention, seed polymerization may also preferably be used in which polymerizable monomers are additionally adsorbed on colorant-containing polymer particles once obtained, and thereafter polymerized using a polymerization initiator. An example of a flow chart of the production of toner particles by polymerization is shown in FIG. 8.

When the toner particles are incorporated with a low-softening substance in a large quantity from the viewpoint of fixing performance, it is important to encapsulate the low-softening substance in shell resin. As a specific method by which the low-softening substance is encapsulated into toner particles, a low-softening substance whose material polarity in an aqueous medium is smaller than the main polymerizable monomer may be selected and also a small amount of resin or polymerizable monomer with a greater polarity than the main monomer may be added. Thus, toner particles having a core/shell structure wherein the low-softening substance is covered with the shell resin can be obtained. The particle size distribution and particle diameter of the toner particles may be controlled by a method in which the types and amounts of a slightly water-soluble inorganic salt and a dispersant having the action of protective colloids are changed, or by changing mechanical apparatus conditions (e.g., the conditions for agitation, such as the peripheral speed of the rotor, pass times and the shape of agitating blades, the shape of the vessel), or by controlling the concentration of solid matter in an aqueous solution, whereby the intended toner particles can be obtained.

Figure 9:
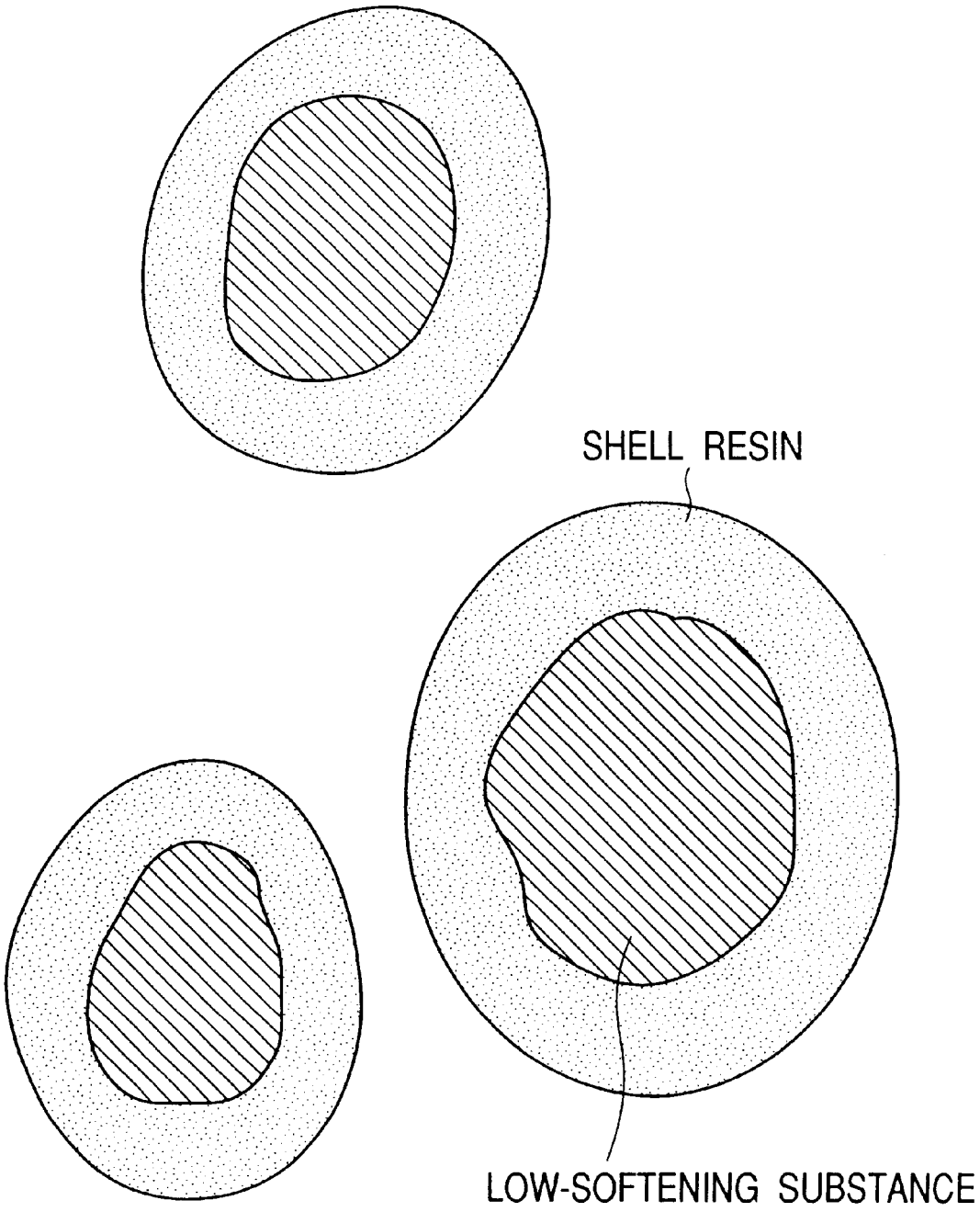
FIG. 9 is a diagrammatic illustration showing cross sections of toner particles.

The core/shell structure can be ascertained by observing cross sections of toner particles. As a specific method, the cross sections of toner particles can be observed in the following way. Toner particles are well dispersed in a room temperature curing epoxy resin, followed by curing in an atmosphere of temperature 40° C. for 2 days. The cured product obtained is dyed with triruthenium tetraoxide optionally in combination with triosmium tetraoxide. Thereafter, samples are cut out in slices by means of a microtome having a diamond cutter, to observe the form of cross sections of toner particles using a transmission electron microscope (TEM). It is preferable to use the triruthenium tetraoxide dyeing method in order to form a contrast between the materials by utilizing some difference in crystallinity between the low-softening substance and the resin constituting the shell. A typical example is shown in FIG. 9. It has been observed that toner particles produced in Examples given later have the structure wherein the low-softening substance is encapsulated with the shell resin.

The polymerizable monomer used to form the toner particles may include vinyl monomers. As the vinyl monomers, preferred are styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and butadiene, isoprene, cyclohexene, acrylo- or methacrylonitrile and acrylic acid amide. Any of these may be used alone or in the form of an appropriate mixture of vinyl monomers so mixed that the theoretical glass transition temperature (Tg) as described in POLYMER HANDBOOK, 2nd Edition III, pp.139–192 (John Wiley & Sons, Inc.) ranges from 40 to 75° C. If the theoretical glass transition temperature is lower than 40° C., problems may arise in respect of storage stability of toners or running stability of developers. If on the other hand it is higher than 75° C., the fixing temperature of toner images may become higher. Especially in the case of color toners used to form full-color images, the color mixing performance of the respective color toners may lower, resulting in a poor color reproducibility, and also OHP images may have a low transparency.

As the low-softening substance used in the toner particles according to the present invention, it is preferable to use a material showing a maximum endothermic peak temperature of from 40 to 90° C. as measured according to ASTM D3418-8. If the maximum endothermic peak temperature is lower than 40° C., the low-softening substance may have a weak self-cohesive force, resulting in weak high-temperature anti-offset properties. This is not desirable for color toners used to form full-color images. If on the other hand the maximum endothermic peak temperature is higher than 90° C., fixing temperature may become higher to make it difficult to smoothen the fixed-image surface appropriately. This is undesirable in view of color mixing performance. Moreover, in the case when the toner particles are directly produced by polymerization, if the maximum endothermic peak is at a high temperature, the low-softening substance may precipitate from polymerizable monomers to hinder the granulation undesirably, because the granulation and polymerization are carried out in an aqueous medium.

The peak top temperature of the maximum endothermic peak is measured using, e.g., DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

The low-softening substance may specifically include paraffin waxes, polyolefin waxes, Fischer-Tropsch waxes, amide waxes, higher fatty acids, ester waxes, and derivatives of these or grafted or blocked compounds of these.

Ester waxes having at least one long-chain ester moiety having at least 10 carbon atoms as shown by the following structural formulas are particularly preferred in the present invention as being effective for the high temperature anti-offset properties without impairment of the transparency required for OHP. Structural formulas of the ester waxes preferred in the present invention are shown below as Formulas (I) to (VI).

Ester Wax of Formula (I)

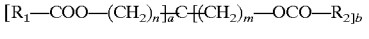

wherein a and b each represent an integer of 0 to 4, provided that a +b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

Ester Wax of Formula (II)

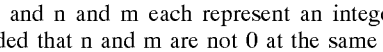

wherein a and b each represent an integer of 0 to 4, provided that a +b is 4; $R_1$ represents an organic group having 1 to 40 carbon atoms; and n and m each represent an integer of 0 to 15, provided that n and m are not 0 at the same time.

Ester Wax of Formula (III)

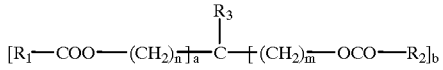

wherein a and b each represent an integer of 0 to 3, provided that a +b is 3; $R_1$ and $R_2$ each represent an organic group having 1 to 40 carbon atoms, provided that a difference in the number of carbon atoms between $R_1$ and $R_2$ is 10 or more; $R_3$ represents an organic group having 1 or more carbon atoms; and n and m each represent an integer of 0 to 15, provided that n and m are not 0 at the same time.

Ester Wax of Formula (IV)

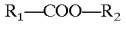

wherein $R_1$ and $R_2$ may be the same or different and each represent a hydrocarbon group having 15 to 45 carbon atoms.

Ester Wax of Formula (V)

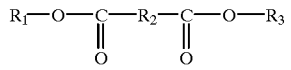

wherein $R_1$ and $R_3$ each represent an organic group having 6 to 32 carbon atoms; $R_1$ and $R_3$ may be the same or different; and $R_2$ represents an organic group having 1 to 20 carbon atoms.

Ester Wax of Formula (VI)

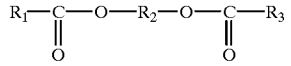

wherein $R_1$ and $R_3$ each represent an organic group having 6 to 32 carbon atoms; $R_1$ and $R_3$ may be the same or different; and $R_2$ represents $—CH_2CH_2OC_6H_4OCH_2CH_2—$,

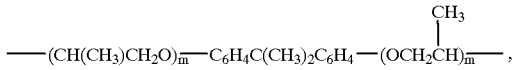

or $—(CH_2)_n—$; and m represents an integer of 1 to 10, and n an integer of 1 to 20.

The ester wax preferably used in the present invention may preferably be those having a hardness of from 0.5 to 5.0. The hardness of the ester wax is a value obtained by preparing a sample having a cylindrical shape of 20 mm diameter and 5 mm thick and thereafter measuring Vickers hardness by the use of, e.g., a dynamic ultrafine hardness meter (DUH-200) manufactured by Shimadzu Corporation. As measurement conditions, a penetrator's position is moved by 10 $\mu$m under conditions of a load of 0.5 g and a loading rate of 9.67 mm/sec. Thereafter, it is kept as it is for 15 seconds, and a depression made on the sample is measured to determine Vickers hardness. If the ester wax has a hardness lower than 0.5, fixing assemblies may have a great dependence on pressure and on process speed, tending to lower the high-temperature anti-offset effect. If on the other hand it has a hardness higher than 5.0, the toner may have a low storage stability, and the wax itself may also have a weak self-cohesive force to likewise lower the high-temperature anti-offset properties.

As specific compounds, the ester wax may include the following compounds.

Ester Compound (1)

Ester Compound (1)

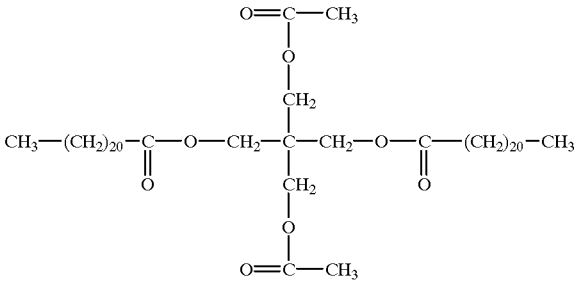

-continued

Ester Compound (2)

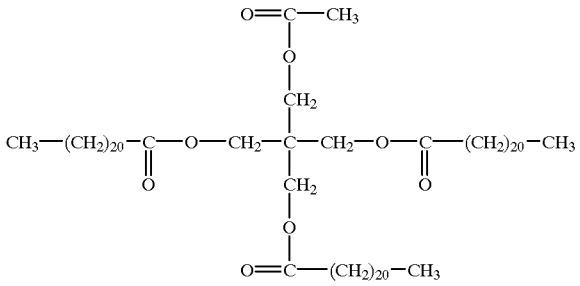

Ester Compound (3)

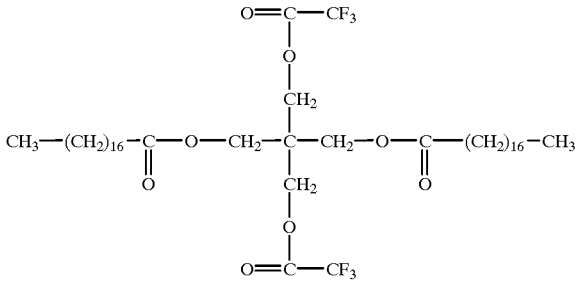

Ester Compound (4)

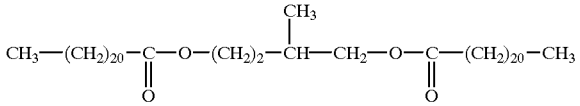

Ester Compound (5)

$CH_3—(CH_2)_{20}COO(CH_2)_{21}CH_3$

Ester Compound (6)

$CH_3—(CH_2)_{16}COO(CH_2)_{21}CH_3$

Ester Compound (7)

$CH_3—(CH_2)_{39}COO(CH_2)_{17}CH_3$

Ester Compound (8)

$CH_3—(CH_2)_{20}COO(CH_2)_{17}CH_3$

Ester Compound (9)

Ester Compound (9)

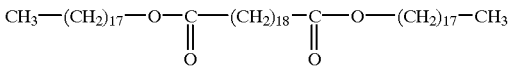

Ester Compound (10)

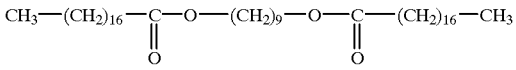

Ester Compound (11)

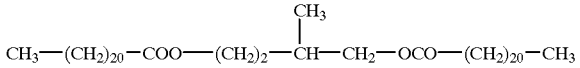

In recent years, it has become increasingly necessary to form full-color double-sided images. When such double-sided images are formed, there is a possibility that a toner image first formed on the surface of a transfer medium again passes through the heating section of a fixing assembly also when an image is next formed on the back. Thus, the high-temperature anti-offset properties of the toner must be well taken into account. For this end also, it is important to add the low-softening substance in a large amount. Stated specifically, the low-softening substance may preferably be added in the toner particles in an amount of from 5 to 30% by weight. Its addition in an amount less than 5% by weight may lower the high-temperature anti-offset properties. Moreover, the back-side images tend to show the phenomenon of offset when double-sided images are fixed. On the other hand, in an amount more than 30% by weight, the toner particles tend to coalesce one another during granulation, so that those having a broad particle size distribution tend to be produced.

In the present invention, in order to encapsulate the low-softening substance in the shell resin of toner particles, it is particularly preferable to further add a polar resin in addition to the shell resin. As the polar resin, copolymers of styrene with acrylic or methacrylic acid, maleic acid copolymers, saturated polyester resins, unsaturated polyester resins and epoxy resins are preferably used. The polar resin may particularly preferably be those not containing in the molecule any unsaturated groups that may react with the shell resin and the polymerizable monomer. If a polar resin having such unsaturated groups is used, cross-linking reaction takes place between the polar resin and the polymerizable monomer that forms the shell resin layer, so that the shell resin comes to have a too high molecular weight for the toners for forming full-color images and is disadvantageous for color mixing performance of color toners. Thus, such a resin is not preferable.

As the fine-particle colorant used in the present invention, carbon black, magnetic materials, and colorants toned in black by the use of yellow, magenta and cyan colorants shown below may be used as black colorants. The fine-particle colorant may preferably comprise primary particles having a number-average particle diameter of 0.5 $\mu$m or smaller, more preferably 0.3 $\mu$m or smaller.

As a yellow colorant, condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147 and 168 are preferably used.

As a magenta colorant, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are particularly preferred.

As a cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution. The colorants are selected taking account of hue angle, chroma, brightness, weatherability, transparency on OHP films and dispersibility in toner particles. The non-magnetic colorant may be added in an amount of from 1 to 20 parts by weight based on 100 parts by weight of the monomer mixture, finally. In the toner particles, the colorant may preferably be contained in an amount of from 1 to 20 parts by weight based on 100 parts by weight of the toner particles.

In the case when a magnetic material is used as the black colorant, it may be used in an amount of from 40 to 150 parts by weight based on 100 parts by weight of the monomer mixture.

As a charge control agent used in the present invention, known agents may be used. It is preferable to use charge control agents that are colorless, make toner charging speed higher and are capable of stably maintaining a constant charge quantity. Also, charge control agents having no polymerization inhibitory action and being insoluble in aqueous mediums are particularly preferred. As specific compounds, they may include, as negative charge control agents, metal compounds of salicylic acid, naphthoic acid or dicarboxylic acids, polymer type compounds having sulfonic acid or carboxylic acid in the side chain, boron compounds, urea compounds, silicon compounds and carixarene. As positive charge control agents, they may include quaternary ammonium salts, polymer type compounds having such a quaternary ammonium salt in the side chain, guanidine compounds, and imidazole compounds. Any of these charge control agents may preferably be used in a amount of from 0.5 to 10 parts by weight based on 100 parts by weight of the monomer mixture. In the present invention, however, the addition of the charge control agent is not essential. In the case when two-component development is employed, the triboelectric charging between a carrier and a toner may be utilized. In the case when non-magnetic one-component blade coating development is employed, the triboelectric charging between a blade member or sleeve member and a toner may be utilized. Hence, the charge control agent need not necessarily be contained in the toner particles.

A polymerization initiator used to form the toner particles according to the present invention may include azo or diazo type polymerization initiators such as 2,2'-azobis-(2,4-dimethylvaleronitrile), 2,2'-azobisisobutyronitrile), 1,1'-azobis-(cyclohexane-l-carbonitrile), 2,2'-azobis4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide and t-butylperoxydiethyl hexanoate. The polymerization initiator may usually be used in an amount of from 0.5 to 20% by weight based on the weight of the polymerizable monomers, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added.

When the suspension polymerization making use of a dispersion stabilizer is utilized in the present invention, the dispersion stabilizer used may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Any of the stabilizers may preferably be used in an amount of from 0.2 to 20 parts by weight based on 100 parts by weight of the polymerizable monomer.

As these dispersion stabilizers, those commercially available may be used as they are. In order to obtain fine particles, however, the inorganic compound may be formed in an aqueous medium. For example, in the case of tricalcium phosphate, an aqueous sodium phosphate solution and an aqueous calcium chloride solution may be mixed under high-speed agitation.

In order to make the dispersion stabilizer finely dispersed, 0.001 to 0.1% by weight of a surface-active agent may be used. As examples the surface-active agent, it may include sodium dodecylbenzenesulfate, sodium tetradecylsulfate, sodium pentadecylsulfate, sodium octylsulfate, sodium oleate, sodium laurate, potassium stearate and calcium oleate.

The toner production process of the present invention will be described more specifically.

To the polymerizable monomer, the colorant, the charge control agent, the low-softening substance (having the function as a release agent) and other additives are added to obtain a monomer mixture, which is then dispersed by means of the media type dispersion machine in which the direction of the flow of the monomer mixture is in agreement with the direction of the centrifugal force. Thereafter, the polymerization initiator may be added to the monomer mixture to prepare a polymerizable monomer composition, which is then uniformly dispersed in the aqueous dispersion medium containing the dispersion stabilizer, by means of a conventional agitator, CLEAR MIX brand mixer, homogenizer, homomixer or ultrasonic dispersion machine. Granulation is carried out preferably while controlling the agitation speed and time so that droplets of the monomer mixture can have the desired toner particle size. After the granulation, agitation may be carried out to such an extent that the state of particles is maintained and the particles can be prevented from settling, by the action of the dispersion stabilizer. Then, polymerization may be carried out at a temperature set at 40° C. or above, usually from 50 to 90° C. At the latter half of the polymerization, the temperature may be raised, and also the aqueous dispersion medium may be removed in part from the reaction system at the latter half of the reaction or after the reaction has been completed, in order to remove unreacted polymerization monomers, by-products and so forth which are causative of a smell at the time of toner fixing. After the reaction has been completed, the toner particles formed are collected by washing and filtration, followed by drying to produce toner particles. Without adding the polymerization initiator to the monomer mixture, the polymerization initiator may be added to the aqueous dispersion medium after the granulation of the polymerizable monomer composition in the aqueous dispersion medium, or to the aqueous dispersion medium during polymerization of the polymerizable monomer present in the particles of the polymerizable monomer composition, to polymerize polymerizable monomers of the particles.

In the suspension polymerization, water may usually be used as an aqueous medium preferably in an amount of from 300 to 3,000 parts by weight based on 100 parts by weight of the monomer mixture.

Particle size distribution of the toner can be measured by various methods. Here, it is measured by the Coulter method, using a Coulter MULTISIZER brand particle size distribution measuring device.

As a measuring device, Coulter MULTISIZER (manufactured by Coulter Electronics, Inc.) is used. An interface (manufactured by Nikkaki K.K.) that outputs number-average distribution and volume-average distribution and a personal computer PC9801 (manufactured by NEC Corporation) are connected. As an electrolytic a solution, an aqueous 1% NaCl solution is prepared using first-grade sodium chloride.

Measurement is made by adding as a dispersant 0.1 to 5 ml of a surface active agent, preferably alkylbenzene sulfonate to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The values are determined by measuring the particle size distribution of particles of 2 to 40 $\mu$m on the basis of number, by means of the Coulter MULTISIZER brand measuring device using an aperture of 100 $\mu$m as its aperture.

In the present invention, the fine-particle colorant stands dispersed in the monomer mixture finely and uniformly, and hence a toner with small particle diameters, having a weight-average particle diameter of from 4 to 10 $\mu$m (more preferably from 4 to 9 $\mu$m) and a sharp particle size distribution that the coefficient of variation in number distribution is 35% or less (more preferably 30% or less), can be formed in a good efficiency and in a good yield.

The coefficient of variation in number distribution is calculated from the following expression.

Coefficient of variation (%)=[S/D1]×100 where S represents a standard deviation in number distribution of toner particles, and Dl represents a number-average particle diameter ($\mu$m) of the toner particles.

[EXAMPLES]

The present invention will be described below in greater detail by giving Examples.

Example 1

The step of dispersion was carried out using the dispersion system shown in FIG. 2. In the dispersion system, 170 parts by weight of styrene monomer, 10 parts by weight of a fine-particle magenta colorant (C.I. Pigment Red 122; number average particle diameter: 0.05 $\mu$m or smaller) and 3 parts by weight of a negative charge control agent (a dialkylsalicylic acid metal compound) were introduced into a holding tank 8. The agitating blades were rotated by means of an agitator motor 13 to prepare a styrene monomer mixture containing the fine-particle magenta colorant. At that stage, cooling water was introduced into a jacket 18 through a feed opening 16 and discharged out of the tank through a discharge outlet 17 so that the liquid temperature of the styrene monomer mixture was adjusted to about 20° C. The styrene monomer mixture thus prepared was introduced into the media particle agitation type wet-dispersion machine 1 by means of a circulating pump 10; the dispersion machine being loaded with spherical media particles (spherical zirconia particles of 0.3 mm diameter) at a packing of $8\times10^{-4}$ $m^3$ (about $6.8\times10^7$ particles). The ratio of the total volume A of the media particles to the space volume B of the dispersion machine 1, A/B, was 1.2.

As shown in FIGS. 2 to 5, the media particle agitation type wet-dispersion machine 1 has a rotor 3 (diameter: 220 mm) in a casing 2. The styrene monomer mixture was introduced into it from a first wall surface having a liquid-feed opening 6 at the middle area while rotating the rotor 3 at a number of revolutions of 8.7 r.p.s. (peripheral speed: 6 m/s) by means of a drive shaft 21 driven by a motor the dispersion machine has. The quantity of styrene monomer mixture introduced into the casing 2 was adjusted by means of the circulating pump 10 to come be 0.9 $m^3$/h. The styrene monomer mixture introduced through the liquid-feed opening 6 was transported toward a separator 4 from the middle of an inner chamber 22 by the aid of a centrifugal force produced by the rotation of the rotor 3. The styrene monomer mixture containing the fine-particle colorant was further passed between layers of media particles flowing on the separator 4, whereupon the fine-particle colorant was made finer and dispersed in the styrene monomer mixture by the aid of the rotation of the rotor 3 and a shear force of media particles 5.

Then the styrene monomer mixture having the fine-particle colorant thus dispersed was transported to an outer chamber 23 through slits 4*a*. The styrene monomer mixture was discharged out of the casing through a discharge opening 7 provided in the side wall (a second wall surface), was passed through a valve 19, a thermometer 12 and a viscometer 25, and was introduced into the holding tank 8 through a cooling means 11. The styrene monomer mixture discharged through the liquid-discharge opening 7 had a temperature of 25° C. as measured with the thermometer 12. Accordingly, the temperature of the styrene monomer mixture was adjusted to 20° C. by means of the cooling means 11 through a feed opening 14 of which cooling water was kept introduced and through a discharge opening 15 of which the cooling water was kept discharged. At this stage, the styrene monomer mixture had a viscosity of 20 mPa·s. Power consumption was 7 kW.

Thereafter, upon lapse of 10 minutes, the styrene monomer mixture showed a viscosity of 55 mPa·s. Accordingly, the number of revolutions of the rotor was changed to a high-speed rotation of 16.7 r.p.s. (peripheral speed: 11.5 m/s), where the fine-particle colorant was dispersed in the styrene monomer mixture over a period of 60 minutes. Power consumption shown after 10 minutes was at a constant value of 8.5 kW, and a fine-particle-colorant-containing monomer mixture finally obtained had a viscosity of 700 mPa·s. Thereafter, the styrene monomer mixture in which the fine-particle colorant had been dispersed finely and uniformly was transported to a preparation step by operating a three-way valve 20.

After the dispersion step was completed, the dispersion formed was collected from the dispersion machine, where the dispersion was well collected. Also, after the dispersion step was completed, the media particles were visually examined, where the media particles were found not to have undergone any changes.

In the preparation step, 30 parts by weight of n-butyl acrylate monomer, 20 parts by weight of a polar resin (saturated polyester resin: polyester resin produced by condensation polymerization of terephthalic acid with bisphenol A modified with propylene oxide; acid value: 13 mg KOH/g; main-peak molecular weight: 7,000) and 25 parts by weight of an ester wax [Ester Compound (1); DSC maximum endothermic peak temperature: about 60° C.] were added to the styrene monomer mixture having 170 parts by weight of styrene monomer, 10 parts by weight of the fine-particle magenta colorant and 3 parts by weight of the negative charge control agent, and were mixed at 60° C., followed by further addition of 10 parts by weight of 2,2'-azobis-(2,4-dimethylvaleronitrile) as a polymerization initiator, thus a polymerizable monomer composition was prepared.

Meanwhile, into a four-necked vessel having a high-speed stirrer TK-homomixer, 710 parts by weight of ion-exchanged water and 450 parts by weight of an aqueous 0.1 mole/liter $Na_3PO_4$ solution were put, and the mixture obtained was heated to 60° C. while adjusting the number of revolutions to 200 r.p.s. Then, 68 parts by weight of an aqueous 1.0 mole/liter $CaCl_2$ solution was added thereto to obtain an aqueous dispersion medium containing $Ca_3(PO_4)_2$, a fine slightly water-soluble dispersion stabilizer.

Then, 268 parts by weight of the polymerizable monomer composition, heated to a temperature of 60° C., was put into the above aqueous dispersion medium heated to a temperature of 60° C., to carry out granulation for 13 minutes while rotating the TK-homomixer at 200 r.p.s. Thereafter, the high-speed stirrer was changed to a stirrer having propeller stirring blades and reaction was carried out at 60° C. for 5 hours, and then the liquid temperature was raised to 80° C. to carry out the reaction for 10 hours.

After the polymerization was completed, a portion of the slurry formed was sampled, and further washed and dried to measure physical properties of the magenta toner particles obtained.

The magenta toner particles thus obtained had a weight-average particle diameter of 6.5 $\mu$m. The coefficient of variation in number distribution was 28%.

As a result of TEM observation, the magenta toner particles obtained were found to have the structure as shown in FIG. 9 that the low-softening substance, ester wax was covered with the shell resin.

To 100 parts by weight of the magenta toner particles thus obtained, 0.7 part by weight of hydrophobic fine silica powder having a specific surface area of 200 $m^2/g$ as measured by the BET method was externally added to prepare a magenta toner. To 7 parts by weight of the magenta toner, 93 parts by weight of an acryl-coated magnetic ferrite carrier was blended to produce a two-component developer.

This developer was put in a commercially available plain-paper color copying machine (COLOR LASER COPYER 500, manufactured by CANON INC.), and images were reproduced in an environment of 23° C./65% RH under a development contrast set at 300 V. On the images formed, their reflection density was measured with a densitometer Macbeth RD918 using an SPI filter (the same applies in the measurement of image density herein described later) to make evaluation.

Results obtained are shown in Table 1.

As for evaluation criteria, an instance where the value of Macbeth density is 1.2 or more indicates a good image density; from 1.0 to less than 1.2, an image density slightly problematic on images but no problem in practical use; and less than 1.0, an image density considerably seriously affecting images and not desirable for products.

Example 2

Dispersion was carried out in the same manner as in Example 1 except for using media particles (material: zirconia) of 0.8 mm diameter at a packing of $8\times10^{-4}$ $m^3$ (about $3.6\times10^6$ particles) (A/B=1.2). Upon lapse of 12 minutes, the styrene monomer mixture showed a viscosity of 53 mPa·s. Accordingly, the number of revolutions of the rotor was changed to a high-speed rotation of 16.7 r.p.s. (peripheral speed: 11.5 m/s), where the fine-particle colorant was dispersed in the styrene monomer mixture over a period of 60 minutes. Power consumption shown after 10 minutes was at a constant value of 8.5 kW, and a fine-particle-colorant-containing monomer mixture finally obtained had a viscosity of 690 mPa·s. The subsequent procedure was repeated in the same manner as in Example 1 to obtain magenta toner particles. The magenta toner particles thus obtained had a weight-average particle diameter of 6.7 $\mu$m. The coefficient of variation in number distribution was 32%.

Using the magenta toner particles obtained, a two-component developer was produced in the same manner as in Example 1. Using this developer, images were reproduced and image density was measured under the same conditions as in Example 1. Results obtained are shown in Table 1.

The state of dispersion and the granulation performance in the step of granulation were also evaluated in the same manner as in Example 1. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 3

Dispersion was carried out in the same manner as in Example 1 except that, after the styrene monomer mixture showed a viscosity of 55 mPa·s upon lapse of 10 minutes, the number of revolutions of the rotor was changed to a high-speed rotation of 20.8 r.p.s. (peripheral speed: 14.4 m/s). Power consumption shown after 10 minutes was at a constant value of 9.5 kW, and a fine-particle-colorant-containing monomer mixture finally obtained had a viscosity of 770 mPa·s. The subsequent procedure was repeated in the same manner as in Example 1 to obtain magenta toner particles. The magenta toner particles thus obtained had a weight-average particle diameter of 6.6 $\mu$m. The coefficient of variation in number distribution was 26%.

Using the magenta toner particles, a two-component developer was produced in the same manner as in Example 1. Using this developer, images were reproduced and image density was measured under the same conditions as in Example 1. Results obtained are shown in Table 1.

The state of dispersion and the granulation performance in the step of granulation were also evaluated in the same manner as in Example 1. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 4

Using the same monomer mixture as that used in Example 1, the media particle agitation type wet-dispersion machine shown in FIGS. 2 to 5 (rotor diameter: 450 mm) was loaded with media particles (material: zirconia) of 0.3 mm diameter at a packing of $4.77\times10^{-3}$ $m^3$ (about $4.1\times10^7$ particles) (A/B=1.0). The dispersion machine was operated at a number of revolutions of 4.3 r.p.s. (peripheral speed: 6.2 m/s). Here, the circulating pump was so controlled that the flow rate of the mixture came to be 3.6 $m^3/h$. At this stage, the viscosity of the styrene monomer mixture was 25 mPa·s and the power consumption was 28 kW. Thereafter, upon lapse of 15 minutes, the styrene monomer mixture showed a viscosity of 51 mPa·s. Accordingly, the number of revolutions of the rotor was changed to a high-speed rotation of 8.3 r.p.s. (peripheral speed: 11.8 m/s), where the fine-particle colorant was dispersed in the styrene monomer mixture over a period of 60 minutes. Power consumption shown after 15 minutes was at a constant value of 32 kW, and a fine-particle-colorant-containing monomer mixture finally obtained had a viscosity of 750 mPa·s.

In the dispersion thus prepared, the same n-butyl acrylate monomer, saturated polyester resin and ester wax [Ester Compound (1)] as those used in Example 1 were dissolved in the same way, followed by addition of 10 parts by weight of a polymerization initiator 2,2'-azobis-(2,4-dimethylvaleronitrile). The mixture obtained was put into the aqueous dispersion medium to carry out granulation for 13 minutes. Thereafter, the high-speed stirrer was changed to a stirrer having propeller stirring blades and reaction was carried out for at 60° C. for 5 hours, and then the liquid temperature was raised to 80° C. to carry out the reaction for 10 hours.

After the polymerization was completed, a portion of the slurry formed was sampled, and further washed and dried to measure physical properties of the magenta toner particles obtained. The magenta toner particles thus obtained had a weight-average particle diameter of 6.5 pm as measured with the Coulter counter. The coefficient of variation in number distribution was 28%. As a result of TEM observation, the magenta particles were found to have the structure as shown in FIG. 9 that the low-softening substance Ester Compound (1) was covered with the shell resin.

To 100 parts by weight of the magenta toner particles thus obtained, 0.7 part by weight of hydrophobic fine silica powder having a specific surface area of 200 $m^2/g$ as measured by the BET method was externally added to prepare a magenta toner. To 7 parts by weight of the magenta toner, 93 parts by weight of an acryl-coated magnetic ferrite carrier was blended to produce a two-component developer.

Using this developer, images were reproduced and image density was measured under the same conditions as in Example 1. Results obtained are shown in Table 1.

The state of dispersion and the granulation performance in the step of granulation were also evaluated in the same manner as in Example 1. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 5

The procedure of Example 1 was repeated except that, in the preparation step, 30 parts by weight of n-butyl acrylate monomer, 20 parts by weight of a polar resin (saturated polyester resin: polyester resin produced by condensation polymerization of terephthalic acid with bisphenol A modified with propylene oxide; acid value: 13 mg KOH/g; main-peak molecular weight: 7,000) and 25 parts by weight of an ester wax [Ester Compound (1); DSC maximum endothermic peak temperature: about 60° C.] were added to a styrene monomer mixture having 170 parts by weight of the styrene monomer, 30 parts by weight of the fine-particle magenta colorant and 3 parts by weight of the negative charge control agent as obtained in a similar manner to that in the dispersion step of Example 1, followed by mixing at 60° C. to obtain a polymerizable monomer composition, and this polymerizable monomer composition and 10 parts by weight of the polymerization initiator 2,2'-azobis-(2,4-dimethylvaleronitrile) were simultaneously put into the aqueous dispersion medium to carry out granulation for 13 minutes by means of the TK-homomixer. The magenta toner particles thus obtained had a weight-average particle diameter of 6.5 $\mu$m. The coefficient of variation in number distribution was 28%.

Using the magenta toner particles obtained, a magenta toner to which hydrophobic fine silica powder was externally added was produced and then a two-component developer was produced both in the same manner as in Example 1. Using this developer, images were reproduced and image density was measured under the same conditions as in Example 1. Results obtained are shown in Table 1.

The granulation performance in the step of granulation was also evaluated in the same manner as in Example 1. Results obtained are shown in Table 1.

Example 6

The procedure of Example 1 was repeated except that the polymerizable monomer composition obtained in Example 5 was put into an aqueous dispersion medium heated to a temperature of 60° C. to carry out granulation for 13 minutes by means of the TK-homomixer and, after the high-speed stirrer was changed to a stirrer having propeller stirring blades, 10 parts by weight of the polymerization initiator 2,2'-azobis-(2,4-dimethylvaleronitrile) was added. The magenta toner particles thus obtained had a weight-average particle diameter of 6.5 $\mu$m. The coefficient of variation in number distribution was 28%.

Using the magenta toner particles obtained, a magenta toner to which hydrophobic fine silica powder was externally added was produced and then a two-component developer was produced both in the same manner as in Example 1. Using this developer, images were reproduced and image density was measured under the same conditions as in Example 1. Results obtained are shown in Table 1.

The granulation performance in the step of granulation was also evaluated in the same manner as in Example 1. Results obtained are shown in Table 1.

Example 7

The step of dispersion was carried out using the dispersion system shown in FIG. 1. In the dispersion system, 170 parts by weight of styrene monomer, 10 parts by weight of a fine-particle magenta colorant (C.I. Pigment Red 122; number average particle diameter: 0.05 $\mu$m or smaller) and 3 parts by weight of a negative charge control agent (a dialkylsalicylic acid metal compound) were introduced into a holding tank 8. The agitating blades were rotated by means of an agitator motor 13 to prepare a styrene monomer mixture containing the fine-particle magenta colorant. At that stage, cooling water was introduced into a jacket 18 through a feed opening 16 and discharged out of the tank through a discharge outlet 17 so that the liquid temperature of the styrene monomer mixture was adjusted to about 20° C. The styrene monomer mixture thus prepared was introduced into the media particle agitation type wet-dispersion machine 1 by means of a circulating pump 10; the dispersion machine being loaded with spherical media particles (spherical zirconia particles of 0.3 mm diameter) at a packing of $8\times10^{-4}$ $m^3$ (about $6.8\times10^7$ particles). The ratio of the total volume A of the media particles to the space volume B of the dispersion machine 1, A/B, was 1.2.

As shown in FIGS. 1 to 5, the media particle agitation type wet-dispersion machine 1 has a rotor 3 (diameter: 220 mm) in a casing 2. The styrene monomer mixture was introduced into it from a first wall surface having a liquid-feed opening 6 at the middle area while rotating the rotor 3 at a number of revolutions of 16.7 r.p.s. (peripheral speed: 11.5 m/s) by means of a drive shaft 21 driven by a motor the dispersion machine has. The quantity of styrene monomer mixture introduced into the casing 2 was adjusted by means of the circulating pump 10 to come be 0.9 $m^3/h$. At that stage, the casing 2 was kept at an internal pressure of 196.1 kPa. The styrene monomer mixture introduced through the liquid-feed opening 6 was transported toward a separator 4 from the middle of an inner chamber 22 by the aid of a centrifugal force produced by the rotation of the rotor 3. The styrene monomer mixture containing the fine-particle colorant was further passed between layers of media particles fluidizing on the separator 4, whereupon the fine-particle colorant was made finer and dispersed in the styrene monomer mixture by the aid of the rotation of the rotor 3 and a shear force of media particles 5.

Then the styrene monomer mixture having the fine-particle colorant thus dispersed was transported to an outer chamber 23 through slits 4*a*. The styrene monomer mixture was discharged out of the casing through a discharge opening 7 provided in the side wall (a second wall surface), was passed through a valve 19 and a thermometer 12, and was introduced into the holding tank 8 through a cooling means 11. The styrene monomer mixture discharged through the liquid-feed opening 6 had a temperature of 29° C. as measured with the thermometer 12. Accordingly, the temperature of the styrene monomer mixture was adjusted to 20° C. by means of the cooling means 11 through a feed opening 14 of which cooling water was kept introduced and through a discharge opening 15 of which the cooling water was kept discharged. The motor for rotating the rotor at this stage showed a power consumption of 13 kW. The power consumption decreased with time to come to be 8.5 kW after 10 minutes, and thereafter became constant at that value. The dispersion step of dispersing the fine-particle colorant in the styrene monomer mixture was carried out for 60 minutes. The styrene monomer mixture passed through the dispersion machine at about 36 times/hour. Thereafter, the styrene monomer mixture in which the fine-particle colorant had been dispersed finely and uniformly was transported to a preparation step by operating a three-way valve 20.

After the dispersion step was completed, the dispersion was collected from the dispersion machine, where the dispersion was well collected. Also, after the dispersion step was completed, the media particles were visually examined, where the media particles were found not to have undergone any changes.

In the preparation step, 30 parts by weight of n-butyl acrylate monomer, 20 parts by weight of a polar resin (saturated polyester resin: polyester resin produced by condensation polymerization of terephthalic acid with bisphenol A modified with propylene oxide; acid value: 13 mg KOH/g; main-peak molecular weight: 7,000) and 25 parts by weight of an ester wax [Ester Compound (1); DSC maximum endothermic peak temperature: about 60° C.] were added to the styrene monomer mixture having 170 parts by weight of the styrene monomer, 10 parts by weight of the fine-particle magenta colorant and 3 parts by weight of the negative charge control agent, and were mixed at 60° C., followed by further addition of 10 parts by weight of 2,2'-azobis-(2,4-dimethylvaleronitrile) as a polymerization initiator, thus a polymerizable monomer composition was prepared.

Meanwhile, into a four-necked vessel having a high-speed stirrer TK-homomixer, 710 parts by weight of ion-exchanged water and 450 parts by weight of an aqueous 0.1 mole/liter $Na_3PO_4$ solution were put, and the mixture obtained was heated to 60° C. while adjusting the number of revolutions to 200 r.p.s. Then, 68 parts by weight of an aqueous 1.0 mole/liter $CaCl_2$ solution was added thereto to obtain an aqueous dispersion medium containing $Ca_3(PO_4)_2$, a fine slightly water-soluble dispersion stabilizer.

Then, 268 parts by weight of the polymerizable monomer composition, heated to a temperature of 60° C., was put into the above aqueous dispersion medium heated to a temperature of 60° C., to carry out granulation for 13 minutes while rotating the TK-homomixer at 200 r.p.s. Thereafter, the high-speed stirrer was changed to a stirrer having propeller stirring blades and reaction was carried out at 60° C. for 5 hours, and then the liquid temperature was raised to 80° C. to carry out the reaction for 10 hours.

After the polymerization was completed, a portion of the slurry formed was sampled, and further washed and dried to measure physical properties of the magenta toner particles obtained. The magenta toner particles thus obtained had a weight-average particle diameter of 6.5 μm as measured with the Coulter counter. The coefficient of variation in number distribution was 28%.

As a result of TEM observation, the magenta toner particles obtained were found to have the structure as shown in FIG. 9 that the low-softening substance ester wax was covered with the shell resin.

To 100 parts by weight of the magenta toner particles thus obtained, 0.7 part by weight of hydrophobic fine silica powder having a specific surface area of 200 $m^2/g$ as measured by the BET method was externally added to prepare a magenta toner. To 7 parts by weight of the magenta toner, 93 parts by weight of an acryl-coated magnetic ferrite carrier was blended to produce a two-component developer.

Using this developer, images were reproduced and evaluated in the same manner as in Example 1.

Results obtained are shown in Table 1.

Example 8

Dispersion was carried out in the same manner as in Example 7 except for using media particles (material: zirconia) of 0.8 mm diameter at a packing of $8\times10^{-4}$ $m^3$ (about $3.6\times10^6$ particles) (A/B=1.2). The motor for rotating the rotor at the drive initial stage showed a power consumption of 12.5 kW. The power consumption decreased with time to come to be 8.5 kW after 10 minutes, and thereafter became constant at that value. The subsequent procedure was repeated in the same manner as in Example 7 to obtain magenta toner particles. The magenta toner particles thus obtained had a weight-average particle diameter of 6.7 μm. The coefficient of variation in number distribution was 32%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 9

The procedure of Example 7 was repeated except that the number of revolutions of the rotor was changed to 20.8 r.p.s. (peripheral speed: 14.4 m/s). The motor for rotating the rotor at the drive initial stage showed a power consumption of 14.5 kW. The power consumption decreased with time to come to be 9.5 kW after 10 minutes, and thereafter became constant at that value. The magenta toner particles obtained had a weight-average particle diameter of 6.5 μm. The coefficient of variation in number distribution was 29%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion a nd the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 10

The procedure of Example 7 was repeated except for using media particles (material: zirconia) of 0.3 mm diameter at a packing of $6.7\times10^{-4}$ $m^3$ (about $5.7\times10^7$ particles) (A/B=1.0). The magenta toner particles obtained had a weight-average particle diameter of 6.6 $\mu$m. The coefficient of variation in number distribution was 26%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 11

Using the same mixture as that used in Example 7, the media particle agitation type wet-dispersion machine (rotor diameter: 450 mm) was loaded with media particles (material: zirconia) of 0.3 mm diameter at a packing of $4.77\times10^{-3}$ $m^3$ (about $4.1\times10^7$ particles) (A/B=1.0). The dispersion was carried out at a number of revolutions of 8.3 r.p.s. (peripheral speed: 11.8 m/s) to obtain liquid monomer mixture. The motor for rotating the rotor at the drive initial stage showed a power consumption of 38.5 kW. The power consumption decreased with time to come to be 32 kW after 10 minutes, and thereafter became constant at that value. Here, the circulating pump was so controlled that the flow rate of the mixture was 3.6 $m^3$/h and the circulation times was 32 times/h. Mill internal pressure was 245.2 kPa.

In the dispersion thus prepared, the same n-butyl acrylate monomer, saturated polyester resin and ester wax [Ester Compound (1)] as those used in Example 7 were dissolved in the same way, followed by addition of 10 parts by weight of a polymerization initiator 2,2'-azobis-(2,4-dimethylvaleronitrile). The mixture obtained was put into the aqueous dispersion medium to carry out granulation for 13 minutes. Thereafter, the high-speed stirrer was changed to a stirrer having propeller stirring blades and reaction was carried out for at 60° C. for 5 hours, and then the liquid temperature was raised to 80° C. to carry out the reaction for 10 hours.

After the polymerization was completed, a portion of the slurry formed was sampled, and further washed and dried to measure physical properties of the magenta toner particles obtained. The magenta toner particles thus obtained had a weight-average particle diameter of 6.5 $\mu$m as measured with the Coulter counter. The coefficient of variation in number distribution was 28%. As a result of TEM observation, the magenta particles were found to have the structure as shown in FIG. 9 that the low-softening substance Ester Compound (1) was covered with the shell resin.

To 100 parts by weight of the magenta toner particles thus obtained, 0.7 part by weight of hydrophobic fine silica powder having a specific surface area of 200 $m^2$/g as measured by the BET method was externally added to obtain a magenta toner. To 7 parts by weight of the magenta toner, 93 parts by weight of an acryl-coated magnetic ferrite carrier was blended to produce a two-component developer.

Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 12

Magenta toner particles were obtained in the same manner as in Example 7 except for using media particles (material: zirconia) of 3 mm diameter at a packing of $8\times10^{-4}$ $m^3$ (about $6.4\times10^4$ particles) (A/B=1.2). The magenta toner particles obtained had a weight-average particle diameter of 8.0 $\mu$m. The coefficient of variation in number distribution was 37%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected.

Example 13

Magenta toner particles were obtained in the same manner as in Example 7 except that the number of revolutions of the rotor was changed to 5 r.p.s. (peripheral speed: 3.5 m/s). The magenta toner particles obtained had a weight-average particle diameter of 9.8 $\mu$m. The coefficient of variation in number distribution was 39%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Example 14

The procedure of Example 7 was repeated except for using media particles (material: zirconia) of 0.3 mm diameter at a packing of $1\times10^{-3}$ $m^3$ (about $8.5\times10^7$ particles) (A/B=1.5).

When the number of revolutions reached a prescribed number of revolutions, the temperature of the mixture circulating inside the system rose to 70° C., and hence the mixture was cooled to 35° C. by the cooling means. This abnormal temperature rise was presumed to be due to the heat generated by mutual friction of the media particles as a result of abnormal closest packing of the media particles in the machine. It was presumed that the rotor and the media particles stood in a sort of co-rotation. The magenta toner particles obtained had a weight-average particle diameter of 9.8 μm. The coefficient of variation in number distribution was 41%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1.

Example 15

The procedure of Example 7 was repeated except for using media particles (material: zirconia) of 0.3 mm diameter at a packing of $4\times10^{-4}$ $m^3$ (about $3.4\times10^7$ particles) (A/B=0.6). The magenta toner particles obtained had a weight-average particle diameter of 8.0 μm. The coefficient of variation in number distribution was 36%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1. After the dispersion step was completed, the dispersion was collected from the dispersion machine, where the dispersion was well collected. Also, after the dispersion step was completed, the media particles were visually examined, where the media particles were found not to have undergone any changes.

Comparative Example 1

The procedure of Example 7 was repeated to obtain the aqueous dispersion medium.

Figure 10:
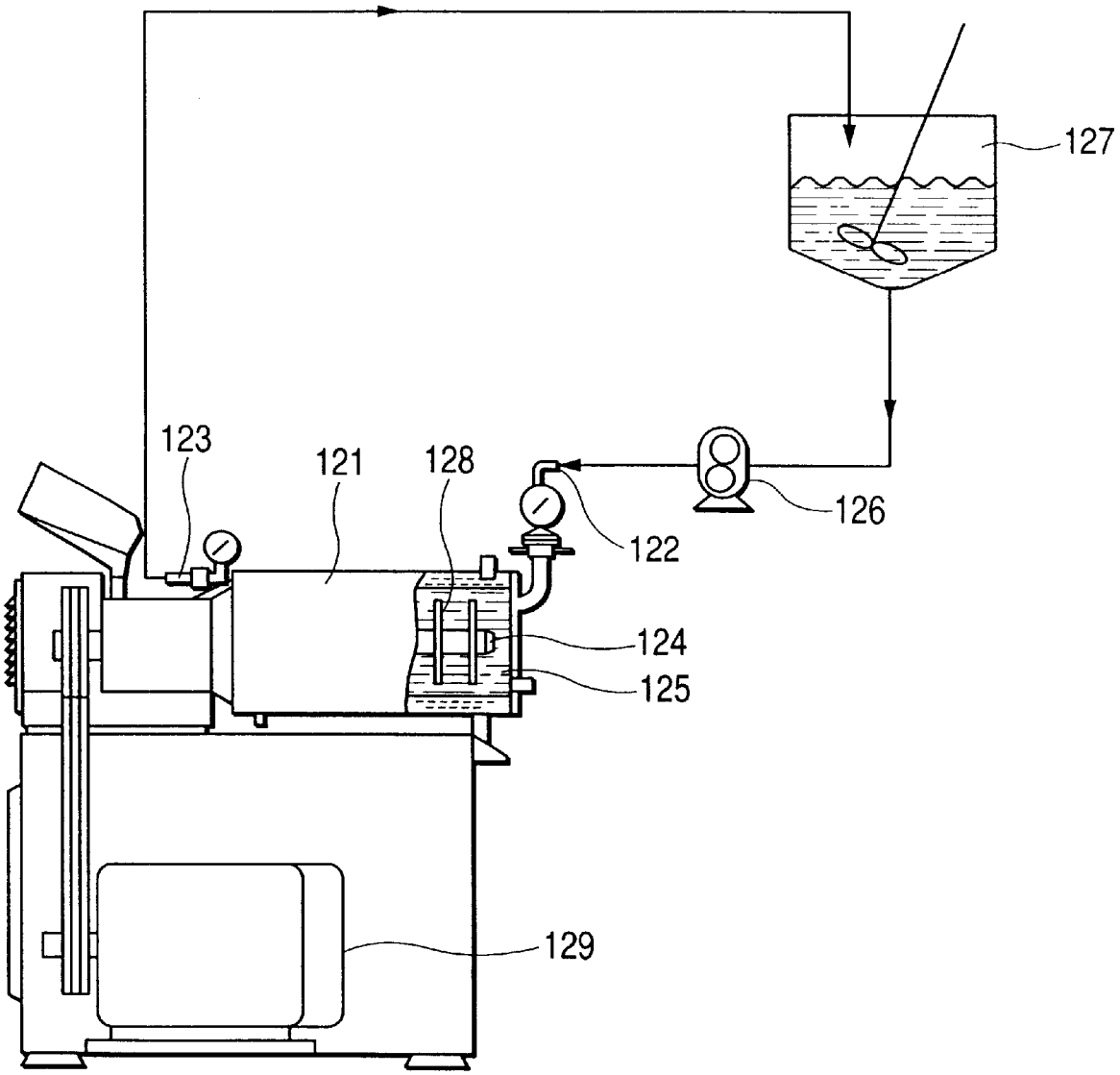
FIG. 10 illustrates an example of a conventional dispersion step.

A polymerizable monomer mixture having the same formulation as that of Example 7 was used. The media type dispersion machine shown in FIG. 10 was loaded with media particles (material: zirconia) of 1 mm diameter at a packing of $1.23\times10^{-2}$ $m^3$. The monomer mixture was fed at a rate of 1 $m^3$/h by means of a pump. Dispersion was carried out by the circulation system at a rotor peripheral speed of 13 m/s for 60 minutes, thus a dispersion was prepared. The procedure of Example 7 subsequent to the dispersion step was repeated to obtain magenta toner particles. The magenta toner particles obtained had a weight-average particle diameter of 12.1 μm. The coefficient of variation in number distribution was 48%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1.

Comparative Example 2

The procedure of Example 7 was repeated to obtain the aqueous dispersion medium.

Figure 11:
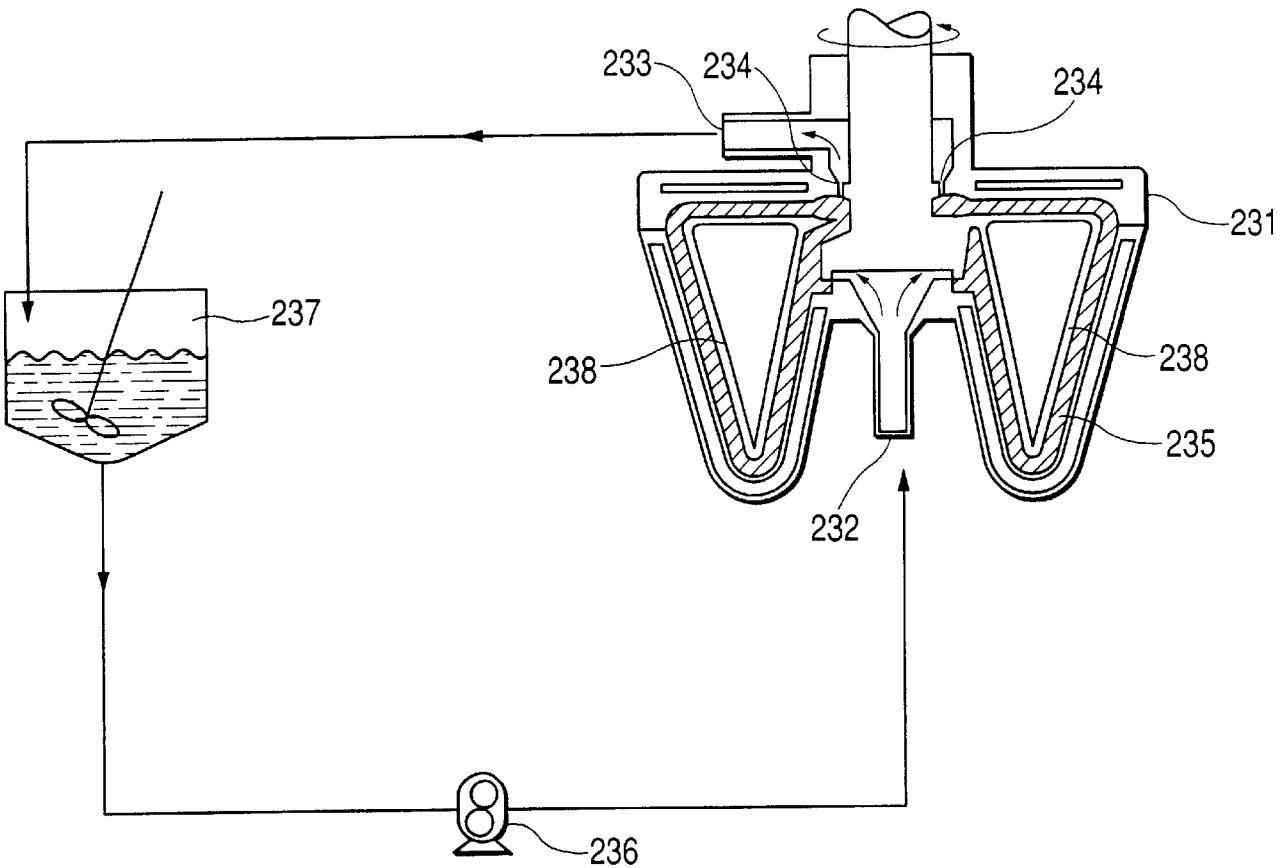
FIG. 11 illustrates another example of a conventional dispersion step.

A polymerizable monomer mixture having the same formulation as that of Example 7 was used. The media type dispersion machine shown in FIG. 11 was loaded with media particles (material: zirconia) of 0.8 mm diameter at a packing of $7.5\times10^{-4}$ $m^3$. The monomer mixture was fed at a rate of $2.25\times10^{-3}$ $m^3$/h by means of a pump. Dispersion was carried out by the circulation system at a rotor peripheral speed of 13 m/s for 60 minutes, thus a dispersion was prepared. The procedure of Example 7 subsequent to the dispersion step was repeated to obtain magenta toner particles. The magenta toner particles obtained had a weight-average particle diameter of 11.3 μm. The coefficient of variation in number distribution was 43%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1.

Comparative Example 3

The procedure of Example 7 was repeated to obtain the aqueous dispersion medium.

A polymerizable monomer mixture having the same formulation as that of Example 7 was heated to 60° C., and was fed into a medialess type dispersion machine Ebara MILDER (manufactured by Eabara Seisakusho K.K.) at a feed rate of 180 kg/h by means of a pump. Dispersion was carried out by the circulation system at a number of rotor revolutions of 5,000 r.p.m. (peripheral speed: 15 m/s) for 60 minutes, thus a dispersion was prepared. The procedure of Example 7 subsequent to the dispersion step was repeated to obtain magenta toner particles. The magenta toner particles obtained had a weight-average particle diameter of 16.3 μm. The coefficient of variation in number distribution was 52%.

Using the magenta toner particles obtained, a two-component developer was produced in the same manner as in Example 7. Using this developer, images were reproduced and image density was measured under the same conditions as in Example 7. Results obtained are shown in Table 1.

The state of dispersion and the granulation performance in the step of granulation were also evaluated in the same manner as in Example 7. Results obtained are shown in Table 1.

TABLE 1

| | State of dispersion (gloss) (%) | Evaluation of dispersion | Granulation performance (variation coeff.) (%) | Evaluation of granulation performance | Image density | Evaluation of image density |
|---|---|---|---|---|---|---|
| Example: | | | | | | |
| 1 | 45 | A | 28 | A | 1.5 | A |
| 2 | 41 | A | 32 | A | 1.3 | A |
| 3 | 42 | A | 29 | A | 1.4 | A |
| 4 | 49 | A | 28 | A | 1.4 | A |
| 5 | — | — | 28 | A | 1.5 | A |
| 6 | — | — | 28 | A | 1.5 | A |
| 7 | 45 | A | 28 | A | 1.5 | A |
| 8 | 41 | A | 32 | A | 1.3 | A |
| 9 | 42 | A | 29 | A | 1.4 | A |
| 10 | 50 | A | 26 | A | 1.5 | A |
| 11 | 49 | A | 28 | A | 1.4 | A |
| 12 | 37 | B | 37 | B | 1.1 | B |
| 13 | 35 | B | 39 | B | 1.1 | B |
| 14 | 35 | B | 39 | B | 1.1 | B |
| 15 | 39 | B | 36 | B | 1.2 | A |
| Comparative Example: | | | | | | |
| 1 | 32 | C | 48 | C | 0.8 | C |
| 2 | 33 | C | 43 | C | 0.9 | C |
| 3 | 29 | C | 52 | C | 0.6 | C |

1) Evaluation of dispersion:
   A: Good;
   B: A little poor (no problem on products).
   C: Poor.
2) Evaluation of granulation performance:
   A: Good.
   B: A little poor (no problem on products).
   C: Poor.
3) Evaluation of image density:
   A: Good.
   B: A little poor (no problem on products).
   C: Poor.

Evaluation Methods

A) With regard to the state of dispersion of the fine-particle colorant in dispersions finally formed, it is evaluated by measuring gloss (glossiness) of dispersions. To measure the gloss of dispersions, dispersions are each coated on art paper, followed by drying well, and gloss of coatings formed is measured. Where the fine-particle colorant stands dispersed well, the coating surfaces have smoothness and lust and have a high gloss. Where on the other hand the fine-particle colorant stands dispersed poorly, the coating surfaces have an unevenness remaining there to stand dull, resulting in a low gloss. The gloss (glossiness) is measured with a gloss meter Model VG-10, manufactured by Nippon Denshoku K.K. For the measurement, voltage is set at 6 V with a constant voltage provider. Then, the projection angle and reception angle are each adjusted to 60 degrees. After the zero-point adjustment and the standardization using a standard plate, three sheets of white paper are overlaid on a sample stand, and the coated samples is placed thereon to make measurement. Numerical values indicated on an indicator are read on the unit of %. As for evaluation criteria, an instance where the value of gloss is 40% or more indicates a good state of dispersion; from 35% to less than 40%, a state of dispersion slightly causative of a problem on images but no problem in practical use; and less than 35%, a state of dispersion considerably seriously affecting images and not desirable for products.

B) With regard to the granulation performance in the granulation step, it is examined on the basis of the coefficient of variation in number distribution measured with the Coulter Multisizer. An instance where this coefficient of variation is less than 35% indicates a good granulation performance; from 35% to less than 40%, a granulation performance slightly causative of a problem on images but no problem in practical use; and 40% or more, a granulation performance considerably seriously affecting images and not desirable for products.

What is claimed is:

1. A process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a granulation step of dispersing the resulting fine-particle-colorant-dispersed liquid monomer mixture in an aqueous dispersion medium to form particles of a polymerizable monomer composition; and a polymerization step of polymerizing polymerizable monomers present in the particles of the polymerizable monomer composition, in the aqueous dispersion medium to form toner particles;

wherein;

(A) in said dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber; and (B) (i) the fine-particle colorant is introduced to the center of the inner chamber through the liquid-feed opening together with the liquid monomer mixture while rotating the rotor by rotary-driving the drive shaft;

(ii) the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles; and (iii) the liquid monomer mixture in which the fine-particle colorant has been dispersed is discharged out of the outer chamber through the liquid-discharge opening to obtain a fine-particle-colorant-containing monomer mixture.

2. The process according to claim 1, wherein said liquid monomer mixture in which the fine-particle colorant has been dispersed is again introduced to the center of the inner chamber of said media particle agitation type wet-dispersion machine through the liquid-feed opening to disperse the fine-particle colorant in the liquid monomer mixture.

3. The process according to claim 1, wherein said liquid monomer mixture is introduced into and discharged out of said media particle agitation type wet-dispersion machine repeatedly so as to be circulated through the system, and the dispersion is carried out for a prescribed time to disperse the fine-particle colorant in the liquid monomer mixture.

4. The process according to claim 1, wherein the media particles held in said media particle agitation type wet-dispersion machine have a diameter within the range of from 0.1 mm to 2 mm.

5. The process according to claim 1, wherein the rotor of said media particle agitation type wet-dispersion machine is rotated at a peripheral speed at the tip portion as controlled within the range of from 5 m/s to 20 m/s.

6. The process according to claim 1, wherein in said media particle agitation type wet-dispersion machine, a total volume A of the media particles and a space volume B between the rotor and the separator are in the range of:

$$0.7<A/B<1.3.$$

7. The process according to claim 1, wherein the liquid monomer mixture having been dispersed in said media particle agitation type wet-dispersion machine is controlled to have a liquid temperature of from 10° C. to 40° C.

8. The process according to claim 1, wherein the liquid monomer mixture having been dispersed in said media particle agitation type wet-dispersion machine is controlled to have a liquid temperature of from 15° C. to 35° C.

9. The process according to claim 1, which further comprises a preparation step of adding an additional liquid polymerizable monomer, a polar polymer and a wax to the fine-particle-colorant-containing monomer mixture having passed through said dispersion step.

10. The process according to claim 9, wherein a polymerization initiator is added after said dispersion step is completed, said preparation step is completed, in the course of said granulation step, or in the course of said polymerization step.

11. The process according to claim 9, wherein;

said liquid monomer mixture in which the fine-particle colorant has been dispersed, discharged through the liquid-discharge opening, is controlled to have a liquid temperature of from 10° C. to 40° C.;

said liquid monomer mixture in which the fine-particle colorant has been dispersed, thus controlled to have a liquid temperature of from 10° C. to 40° C., is again introduced to the center of the inner chamber through the liquid-feed opening to disperse the fine-particle colorant in the liquid monomer mixture; and the dispersion is carried out for a prescribed time to disperse the fine-particle colorant in the liquid monomer mixture to obtain the fine-particle-colorant-containing monomer mixture.

12. The process according to claim 11, wherein the liquid monomer mixture having been dispersed in said media particle agitation type wet-dispersion machine is controlled to have a liquid temperature of from 15° C. to 35° C.

13. The process according to claim 11, wherein the media particles held in said media particle agitation type wet-dispersion machine have a diameter within the range of from 0.1 mm to 2 mm.

14. The process according to claim 11, wherein the rotor of said media particle agitation type wet-dispersion machine is rotated at a peripheral speed at the tip portion as controlled within the range of from 5 m/s to 20 m/s.

15. The process according to claim 11, wherein in said media particle agitation type wet-dispersion machine, a total volume A of the media particles and a space volume B between the rotor and the separator are in the range of:

$$0.7<A/B<1.3.$$

16. The process according to claim 11, wherein a polymerization initiator is added after said dispersion step is completed, said preparation step is completed, in the course of said granulation step, or in the course of said polymerization step.

17. The process according to claim 11, wherein in said dispersion step, the dispersion is carried out for 10 minutes to 300 minutes.

18. The process according to claim 11, wherein in said dispersion step, the dispersion is carried out for 20 minutes to 180 minutes.

19. The process according to claim 11, wherein the number of revolutions of the rotor is made larger with an increase in the viscosity of said fine-particle-colorant-containing monomer mixture.

20. The process according to claim 11, wherein a viscometer is provided between the liquid-discharge opening and the liquid-feed opening to measure viscosity and said dispersion step is carried out while controlling the number of revolutions of the rotor in accordance with values of the viscosity measured.

21. The process according to claim 20, wherein said liquid monomer mixture is introduced into and discharged out of said media particle agitation type wet-dispersion machine repeatedly so as to be circulated through the system, and the dispersion is carried out for a prescribed time to disperse the fine-particle colorant in the liquid monomer mixture.

22. The process according to claim 20, wherein the media particles held in said media particle agitation type wet-dispersion machine have a diameter within the range of from 0.1 mm to 2 mm.

23. The process according to claim 20, wherein the rotor of said media particle agitation type wet-dispersion machine is rotated at a peripheral speed controlled within the range of from 5 m/s to 20 m/s.

24. The process according to claim 20, wherein in said media particle agitation type wet-dispersion machine, a total volume A of the media particles and a space volume B between the rotor and the separator are in the range of:

$$0.7<A/B<1.3.$$

25. The process according to claim 20, wherein the liquid monomer mixture having been dispersed in said media particle agitation type wet-dispersion machine is controlled to have a liquid temperature of from 15° C. to 35° C.

26. The process according to claim 20, wherein a polymerization initiator is added after said dispersion step is completed, said preparation step is completed, in the course of said granulation step, or in the course of said polymerization step.

27. The process according to claim 20, wherein in said dispersion step, the dispersion is carried out for 10 minutes to 300 minutes.

28. The process according to claim 20, wherein the number of revolutions of the rotor is made larger with an increase in the viscosity of said fine-particle-colorant-containing monomer mixture.

29. The process according to claim 20, wherein in said dispersion step, the dispersion is carried out for 20 minutes to 180 minutes.

30. The process according to claim 11, wherein said toner particles have a weight-average particle diameter of from 4 μm to 10 μm and a coefficient of variation in number distribution, of 35% or less.

31. The process according to claim 11, wherein said toner particles have a weight-average particle diameter of from 4 μm to 9 μm and a coefficient of variation in number distribution, of 30% or less.

32. The process according to claim 11, wherein said fine-particle-colorant-containing monomer mixture discharged through the liquid-discharge opening has a viscosity of from 5 mPa·s to 2,500 mPa·s.

33. The process according to claim 1, wherein in said dispersion step, the dispersion is carried out for 10 minutes to 300 minutes.

34. The process according to claim 1, wherein in said dispersion step, the dispersion is carried out for 20 minutes to 180 minutes.

35. The process according to claim 1, wherein the number of revolutions of the rotor is made larger with an increase in the viscosity of said fine-particle-colorant-containing monomer mixture.

36. The process according to claim 1, wherein a viscometer is provided between the liquid-discharge opening and the liquid-feed opening to measure viscosity and said dispersion step is carried out while controlling the number of revolutions of the rotor in accordance with values of the viscosity measured.

37. The process according to claim 36, wherein said liquid monomer mixture in which the fine-particle colorant has been dispersed is again introduced to the center of the inner chamber of said media particle agitation type wet-dispersion machine through the liquid-feed opening to disperse the fine-particle colorant in the liquid monomer mixture.

38. The process according to claim 36, wherein said liquid monomer mixture is introduced into and discharged out of said media particle agitation type wet-dispersion machine repeatedly so as to be circulated through the system, and the dispersion is carried out for a prescribed time to disperse the fine-particle colorant in the liquid monomer mixture.

39. The process according to claim 36, wherein the media particles held in said media particle agitation type wet-dispersion machine have a diameter within the range of from 0.1 mm to 2 mm.

40. The process according to claim 36, wherein the rotor of said media particle agitation type wet-dispersion machine is rotated at a peripheral speed at the tip portion as controlled within the range of from 5 m/s to 20 m/s.

41. The process according to claim 36, wherein in said media particle agitation type wet-dispersion machine, a total volume A of the media particles and a space volume B between the rotor and the separator are in the range of:

$$0.7<A/B<1.3.$$

42. The process according to claim 36, wherein the liquid monomer mixture having been dispersed in said media particle agitation type wet-dispersion machine is controlled to have a liquid temperature of from 10° C. to 40° C.

43. The process according to claim 36, wherein the liquid monomer mixture having been dispersed in said media particle agitation type wet-dispersion machine is controlled to have a liquid temperature of from 15° C. to 35° C.

44. The process according to claim 36, which further comprises a preparation step of adding an additional liquid polymerizable monomer, a polar polymer and a wax to the fine-particle-colorant-containing monomer mixture having passed through said dispersion step.

45. The process according to claim 44, wherein a polymerization initiator is added after said dispersion step is completed, said preparation step is completed, in the course of said granulation step, or in the course of said polymerization step.

46. The process according to claim 36, wherein in said dispersion step, the dispersion is carried out for 10 minutes to 300 minutes.

47. The process according to claim 36, wherein in said dispersion step, the dispersion is carried out for 20 minutes to 180 minutes.

48. The process according to claim 36, wherein the number of revolutions of the rotor is made larger with an increase in the viscosity of said fine-particle-colorant-containing monomer mixture.

49. The process according to claim 36, wherein said toner particles have a weight-average particle diameter of from 4 μm to 10 μm and a coefficient of variation in number distribution, of 35% or less.

50. The process according to claim 36, wherein said toner particles have a weight-average particle diameter of from 4 μm to 9 μm and a coefficient of variation in number distribution, of 30% or less.

51. The process according to claim 36, wherein said fine-particle-colorant-containing monomer mixture discharged through the liquid-discharge opening has a viscosity of from 5 mPa·s to 2,500 mPa·s.

52. The process according to claim 1, wherein said toner particles have a weight-average particle diameter of from 4 μm to 10 μm and a coefficient of variation in number distribution, of 35% or less.

53. The process according to claim 1, wherein said toner particles have a weight-average particle diameter of from 4 μm to 9 μm and a coefficient of variation in number distribution, of 30% or less.

54. The process according to claim 1, wherein said fine-particle-colorant-containing monomer mixture discharged through the liquid-discharge opening has a viscosity of from 5 mPa·s to 2,500 mPa·s.

55. A process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a preparation step of adding a polymerization initiator to the fine-particle-colorant-dispersed liquid monomer mixture in which the fine-particle colorant has been dispersed, to prepare a polymerizable monomer composition;

a granulation step of dispersing the polymerizable monomer composition in an aqueous dispersion medium to form particles of the polymerizable monomer composition; and a polymerization step of polymerizing polymerizable monomers present in the particles of the polymerizable monomer composition, in the aqueous dispersion medium to form toner particles;

wherein;

in said dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber;

the fine-particle colorant is introduced to the center of the inner chamber through the liquid-feed opening together with the liquid monomer mixture while rotating the rotor by rotary-driving the drive shaft;

the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles;

the liquid monomer mixture in which the fine-particle colorant has been dispersed is discharged out of the outer chamber through the liquid-discharge opening;

the liquid monomer mixture in which the fine-particle colorant has been dispersed, thus discharged, is controlled to have a liquid temperature of from 10° C. to 40° C.;

the liquid monomer mixture in which the fine-particle colorant has been dispersed, thus controlled to have a liquid temperature of from 10° C. to 40° C., is again introduced to the center of the inner chamber through the liquid-feed opening to disperse the fine-particle colorant in the liquid monomer mixture;

the dispersion is carried out for a prescribed time to disperse the fine-particle colorant in the liquid monomer mixture to obtain a fine-particle-colorant-containing monomer mixture; and the fine-particle-colorant-containing monomer mixture obtained is fed to said preparation step.

56. The process according to claim 55, wherein said liquid monomer mixture is introduced into and discharged out of said media particle agitation type wet-dispersion machine repeatedly so as to be circulated through the system, and the dispersion is carried out for a prescribed time to disperse the fine-particle colorant in the liquid monomer mixture.

57. The process according to claim 55, wherein the media particles held in said media particle agitation type wet-dispersion machine have a diameter within the range of from 0.1 mm to 2 mm.

58. The process according to claim 55, wherein the rotor of said media particle agitation type wet-dispersion machine is rotated at a peripheral speed controlled within the range of from 5 m/s to 20 m/s.

59. The process according to claim 55, wherein in said media particle agitation type wet-dispersion machine, a total volume A of the media particles and a space volume B between the rotor and the separator are in the range of:

$$0.7<A/B<1.3.$$

60. The process according to claim 55, wherein the liquid monomer mixture having been dispersed in said media particle agitation type wet-dispersion machine is controlled to have a liquid temperature of from 15° C. to 35° C.

61. The process according to claim 55, wherein in said preparation step an additional liquid polymerizable monomer, a polar polymer and a wax are added to the fine-particle-colorant-containing monomer mixture having passed through said dispersion step.

62. The process according to claim 55, wherein in said dispersion step, the dispersion is carried out for 10 minutes to 300 minutes.

63. The process according to claim 55, wherein in said dispersion step, the dispersion is carried out for 20 minutes to 180 minutes.

64. The process according to claim 55, wherein the number of revolutions of the rotor is made larger with an increase in the viscosity of said fine-particle-colorant-containing monomer mixture.

65. The process according to claim 55, wherein said toner particles have a weight-average particle diameter of from 4 μm to 10 μm and a coefficient of variation in number distribution, of 35% or less.

66. The process according to claim 55, wherein said toner particles have a weight-average particle diameter of from 4 μm to 9 μm and a coefficient of variation in number distribution, of 30% or less.

67. The process according to claim 55, wherein said fine-particle-colorant-containing monomer mixture discharged through the liquid-discharge opening has a viscosity of from 5 mPa·s to 2,500 mPa·s.

68. A process for producing a toner having toner particles, comprising;

a dispersion step of dispersing a fine-particle colorant in a liquid monomer mixture containing at least a liquid polymerizable monomer, to obtain a fine-particle-colorant-dispersed liquid monomer mixture;

a preparation step of adding a polymerization initiator to the fine-particle-colorant-dispersed liquid monomer mixture in which the fine-particle colorant has been dispersed, to prepare a polymerizable monomer composition;

a granulation step of dispersing the polymerizable monomer composition in an aqueous dispersion medium to form particles of the polymerizable monomer composition; and a polymerization step of polymerizing polymerizable monomers present in the particles of the polymerizable monomer composition, in the aqueous dispersion medium to form toner particles;

wherein;

(A) in said dispersion step, a media particle agitation type wet-dispersion machine is used as a dispersion means; the dispersion machine comprising;

a cylindrical vessel having a first wall surface having a liquid-feed opening and a second wall surface having a liquid-discharge opening; the vessel being inside provided with an inner chamber and an outer chamber which are partitioned with a cylindrical separator having slits;

a rotor set in the inner chamber rotatably by the rotary drive motion of a drive shaft; and a plurality of spherical media particles held in the inner chamber;

(B) (i) the fine-particle colorant is introduced to the center of the inner chamber through the liquid-feed opening together with the liquid monomer mixture while rotating the rotor by rotary-driving the drive shaft;

(ii) the liquid monomer mixture and the fine-particle colorant are transported to the outer chamber through the slits of the separator by the aid of a centrifugal force produced by the rotation of the rotor while dispersing the fine-particle colorant in the liquid monomer mixture by the aid of a) the centrifugal force produced by the rotation of the rotor and b) the media particles;

(iii) the liquid monomer mixture in which the fine-particle colorant has been dispersed is discharged out of the outer chamber through the liquid-discharge opening, and the liquid monomer mixture in which the fine-particle colorant has been dispersed, thus discharged, is controlled to have a liquid temperature of from 10° C. to 40° C.; and (iv) the liquid monomer mixture in which the fine-particle colorant has been dispersed, thus controlled to have a liquid temperature of from 10° C. to 40° C., is again introduced to the center of the inner chamber through the liquid-feed opening to disperse the fine-particle colorant in the liquid monomer mixture, where;

the viscosity of the liquid monomer mixture is measured with a viscometer provided between the liquid-discharge opening and the liquid-feed opening, and the dispersion is carried out for a prescribed time while controlling the number of revolutions of the rotor in accordance with the measured viscosity, to disperse the fine-particle colorant in the liquid monomer mixture to obtain a fine-particle-colorant-containing monomer mixture; and (C) the fine-particle-colorant-containing monomer mixture obtained is fed to said preparation step.

69. The process according to claim 68, wherein the number of revolutions of the rotor is made larger with an increase in the viscosity of said fine-particle-colorant-containing monomer mixture.

70. The process according to claim 68, wherein said liquid monomer mixture is introduced into and discharged out of said media particle agitation type wet-dispersion machine repeatedly so as to be circulated through the system, and the dispersion is carried out for a prescribed time to disperse the fine-particle colorant in the liquid monomer mixture.

71. The process according to claim 68, wherein the media particles held in said media particle agitation type wet-dispersion machine have a diameter within the range of from 0.1 mm to 2 mm.

72. The process according to claim 68, wherein the rotor of said media particle agitation type wet-dispersion machine is rotated at a peripheral speed controlled within the range of from 5 m/s to 20 m/s.

73. The process according to claim 68, wherein in said media particle agitation type wet-dispersion machine, a total volume A of the media particles and a space volume B between the rotor and the separator are in the range of:

$$0.7<A/B<1.3.$$

74. The process according to claim 68, wherein the liquid monomer mixture having been dispersed in said media particle agitation type wet-dispersion machine is controlled to have a liquid temperature of from 15° C. to 35° C.

75. The process according to claim 68, wherein in said preparation step an additional liquid polymerizable monomer, a polar polymer and a wax to the fine-particle-colorant-containing monomer mixture having passed through said dispersion step.

76. The process according to claim 68, wherein in said dispersion step, the dispersion is carried out for 10 minutes to 300 minutes.

77. The process according to claim 68, wherein in said dispersion step, the dispersion is carried out for 20 minutes to 180 minutes.

78. The process according to claim 68, wherein said toner particles have a weight-average particle diameter of from 4 μm to 10 μm and a coefficient of variation in number distribution, of 35% or less.

79. The process according to claim 68, wherein said toner particles have a weight-average particle diameter of from 4 μm to 9 μm and a coefficient of variation in number distribution, of 30% or less.

80. The process according to claim 68, wherein said fine-particle-colorant-containing monomer mixture discharged through the liquid-discharge opening has a viscosity of from 5 mPa·s to 2,500 mPa·s.

* * * * *